US006402310B1

(12) United States Patent
Maeda et al.

(10) Patent No.: US 6,402,310 B1
(45) Date of Patent: Jun. 11, 2002

(54) INK JET CARTRIDGE, INK JET APPARATUS, AND MANUFACTURE METHOD OF INK JET CARTRIDGE

(75) Inventors: Hiroyuki Maeda, Yokohama; Masafumi Takimoto, Tokyo; Iwao Kawamura, Kunitachi; Kazunori Namai, Yokohama; Kunitoshi Hayashi, Hachioji; Takuya Yasumitsu, Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/603,360

(22) Filed: Jun. 26, 2000

(30) Foreign Application Priority Data

Jun. 30, 1999 (JP) ..... 11-186517

(51) Int. Cl.[7] ..... B41J 2/175
(52) U.S. Cl. ..... 347/87
(58) Field of Search ..... 347/84, 85, 86, 347/87

(56) References Cited

U.S. PATENT DOCUMENTS

| | | | | |
|---|---|---|---|---|
| 4,633,274 A | | 12/1986 | Matsuda | 347/50 |
| 5,368,402 A | * | 11/1994 | Takahashi et al. | 400/279 |
| 5,552,816 A | * | 9/1996 | Oda et al. | 347/86 |
| 5,642,143 A | | 6/1997 | Rhoads | 347/49 |
| 6,199,977 B1 | * | 3/2001 | Komplin et al. | 347/86 |

FOREIGN PATENT DOCUMENTS

| | | |
|---|---|---|
| EP | 494693 | 7/1992 |
| EP | 603901 | 6/1994 |
| EP | 654352 | 5/1995 |
| EP | 699533 | 3/1996 |
| EP | 756936 | 2/1997 |
| EP | 847866 | 6/1998 |
| EP | 856404 | 8/1998 |
| EP | 999060 | 5/2000 |
| JP | 6-312515 | 11/1994 |
| JP | 10-157120 | 6/1998 |

* cited by examiner

*Primary Examiner*—Anh T. N. Vo
(74) *Attorney, Agent, or Firm*—Fitzpatrick, Cella, Harper & Scinto

(57) ABSTRACT

There is disclosed an ink jet cartridge comprising an ink jet head including a plurality of arranged discharge ports for discharging ink, an element substrate provided with a plurality of energy generating elements for generating an energy to discharge the ink, and a base plate for supporting the element substrate; an ink tank holding member for holding an ink tank for containing the ink; and a head holding member for connecting the ink tank holding member to the ink jet head, and by holding the ink jet head by the ink tank holding member and the head holding member, the ink jet head is elastically supported in a head sandwiching direction, so that the positioning of the ink jet head can easily be performed with respect to the ink jet cartridge with a high precision, the high quality recording is possible, and the ink jet apparatus using this cartridge can be realized with a simple construction and at a low cost.

62 Claims, 28 Drawing Sheets

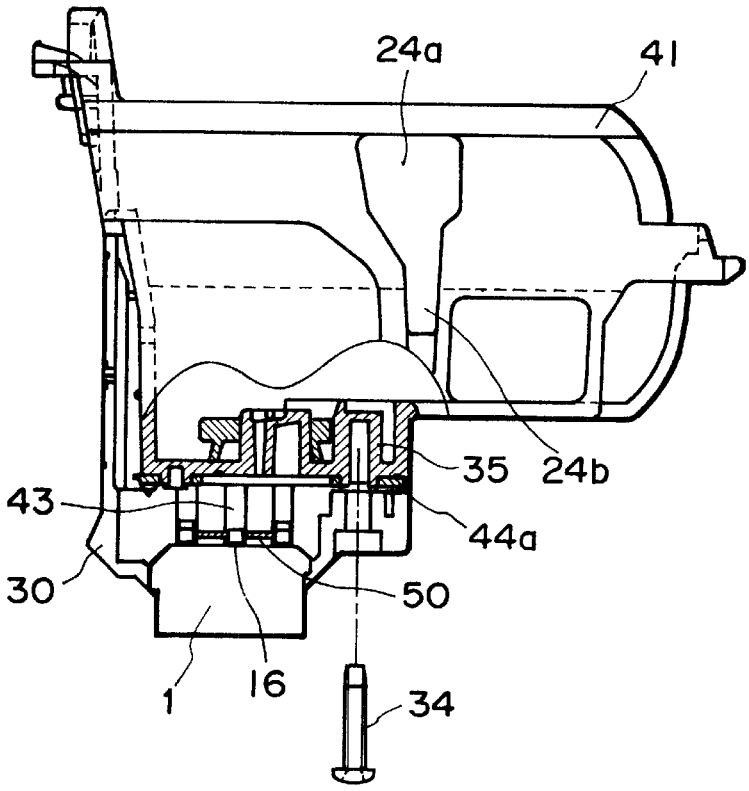
FIG. 12A
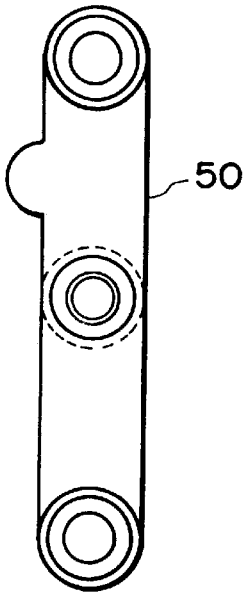
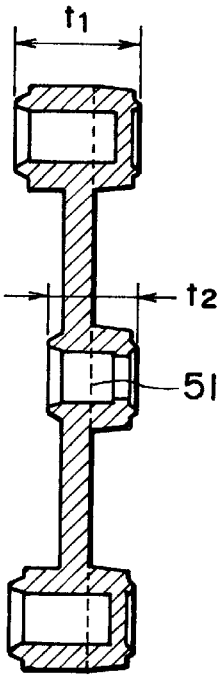
FIG. 12B FIG. 12C

INK JET CARTRIDGE, INK JET APPARATUS, AND MANUFACTURE METHOD OF INK JET CARTRIDGE

BACKGROUND OF THE INVENTION

1. Field of the Invention

The present invention relates to an ink jet cartridge provided with an ink jet head, and an ink jet apparatus using this cartridge.

2. Related Background Art

In recent years, in a calculator, a word processor, a facsimile machine, a copying machine, a printer, and other various electronic apparatuses provided with an image output part for performing recording on a record medium, an ink jet recording method has been extensively utilized in the image output part so that low-noise high-speed recording is possible.

In the ink jet recording method, it is general to use an ink jet cartridge in which the image output part can be disposed to be compact.

FIG. 27 is a perspective view showing a conventional ink jet cartridge. FIG. 28 is a perspective view showing the exploded state of the ink jet cartridge shown in FIG. 27.

As shown in FIGS. 27 and 28, a head cartridge 110 is constituted of an ink jet head 101 provided with an ink discharge port 103 for discharging liquids such as an ink, a head holder 102 as a head holding member with the ink jet head 101 attached thereto, a flexible cable 104 bonded to the ink jet head 101 and attached to the head holder 102, and a tank holder 109 as a tank holding member, detachably attached to the head holder 102, for mounting thereon an ink tank. The ink jet head 101 includes: an element substrate provided with a heat converting element, a piezo element and other energy generating elements for generating an energy utilized to discharge the ink from the ink discharge port 103; and a grooved top plate provided with a groove part constituting an ink flow path, a wall part forming an ink flow path wall, and a hollow part forming a common liquid chamber for supplying the ink to the ink flow path, and the ink flow path and common liquid chamber are formed by bonding the element substrate to the grooved top plate. Moreover, the grooved top plate is integrally formed with an orifice plate provided with a plurality of discharge ports which communicate with the ink flow path.

Moreover, one end of the flexible cable 104 is bonded to the ink jet head 101, and the bonded part of the flexible cable 104 and ink jet head 101 is disposed inside the head holder 102. One surface of the other end of the flexible cable 104 is provided with a plurality of contact pads 105 electrically connected to contact pads which are disposed on an ink jet apparatus main body. When the ink jet cartridge 110 is attached to a carriage disposed on the ink jet apparatus, the contact pad 105 contacts the main body side contact part (not shown) of the ink jet apparatus, so that a signal for discharging the ink via the ink discharge port 103 can be transmitted to the ink jet head 101 through the contact pad 105.

On the other hand, an opening 108 for passing the flexible cable 104 is formed in the surface of the head holder 102 other than the surface on which the ink jet head 101 is disposed. The part of the flexible cable 104 provided with a plurality of contact pads 105 is drawn to the outside of the head holder 102 from the inside of the head holder 102 through the opening 108, and the part of the flexible cable 104 provided with a plurality of contact pads 105 forms an exposed part 104*a* exposed to the outside of the head holder 102.

Additionally, in the constitution of the above-described ink jet cartridge, the ink jet head is fixed by the engagement part molded in the head holding member, but in this constitution, the positioning of the head depends on the precision of the engagement part, and the mold processing precision must be set to be very high.

Moreover, the head positioning is performed using the molded surface as a reference, but a strain is sometimes generated in the molded surface of a molded material. When the strain is large, the desired attachment direction of the head is not obtained, a deviation is generated in a discharge direction, and it cannot necessarily be said that the productivity is high. Furthermore, particularly in the ink jet apparatus in which a plurality of ink jet cartridges are mounted on the carriage, the deviation of the head attachment direction in each ink jet cartridge causes a deviation in a jet position. Therefore, the attachment direction of the head to the ink jet cartridge needs to be set with a higher precision, and the simple constitution of the ink jet cartridge has been demanded in which the head attachment direction can be arranged with the high precision.

SUMMARY OF THE INVENTION

Wherefore, an object of the present invention is to provide an ink jet cartridge with an ink jet head attached thereto, in which the ink jet head is easily positioned with a high precision and high-quality recording is possible, and further to provide an ink jet apparatus with the ink jet cartridge used therein in a simple constitution and at a low cost. To achieve the above-described object, according to the present invention, there is provided an ink jet cartridge comprising: an ink jet head including a plurality of arranged discharge ports for discharging ink, an element substrate provided with a plurality of energy generating elements for generating an energy to discharge the ink, and a base plate for supporting the element substrate; an ink tank holding member for holding an ink tank for containing the ink; and a head holding member for connecting the ink tank holding member to the ink jet head. In the ink jet cartridge, by sandwiching the ink jet head by the ink tank holding member and the head sandwiching member, the ink jet head is elastically supported in a head holding direction.

Moreover, the base plate is preferably inclined with respect to the head holding direction. Further preferably, the ink tank holding member includes an ink supply tube for introducing the ink to the ink jet head, the ink jet head includes an ink flow inlet port for introducing the ink into the ink jet head from the ink tank, an elastic member is disposed between the ink flow inlet port and the ink supply tube, and the head is elastically supported by the elastic force of the elastic member in a state where the head is sandwiched by the ink tank holding member and head holding member.

Furthermore, the ink jet head is preferably fixed to the ink jet cartridge using a force by a rotation moment.

According to the present invention, there is also provided an ink jet apparatus comprising: the above-described ink jet cartridge; and record material conveyance means for conveying a record material which receives the liquid discharged from the ink jet head.

The ink jet cartridge is mounted on the ink jet apparatus in an attachable/detachable state. Moreover, there is also provided an ink jet apparatus comprising: the above-described ink jet cartridge; and recovery means for recovering the ink jet head of the ink jet cartridge. The ink jet cartridge is mounted on the ink jet apparatus in the attachable/detachable state.

Furthermore, the recovery means comprises suction recovery means, or a wiper blade for wiping the surface of the ink jet head provided with a discharge port.

Additionally, when the recovery means comprises the wiper blade, in the ink jet cartridge, a wiper cleaner for cleaning the wiper blade is preferably disposed between the head holding member and the ink jet head.

Moreover, a step is further preferably disposed on the ink jet head side of the wiper cleaner.

BRIEF DESCRIPTION OF THE DRAWINGS

FIGS. 12A, 12B and 12C are explanatory views of the elastic member according to one embodiment of the present invention, FIG. 12A is a partial sectional view of an ink jet cartridge according to one embodiment of the present invention, FIG. 12B is a plan view of the elastic member of the present invention, and FIG. 12C is a sectional view of FIG. 12B.

FIG. 26A is a perspective view seen from a rear surface upper part, and FIG. 26B is a perspective view from a rear surface lower part.

DETAILED DESCRIPTION OF THE PREFERRED EMBODIMENTS

Figure 1:
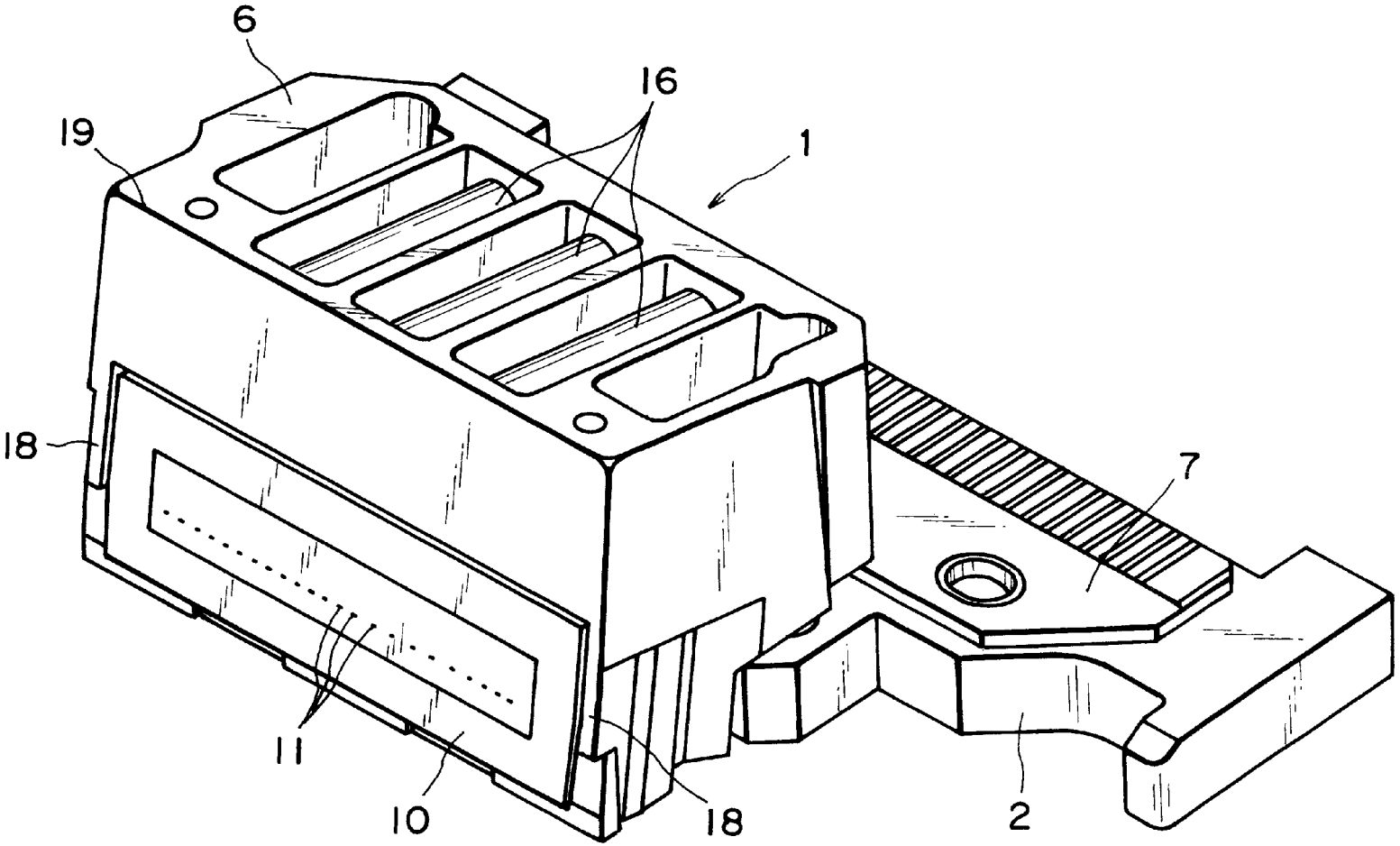
FIG. 1 is a perspective view showing the main part of an ink jet head according to one embodiment of the present invention.

One embodiment of the present invention will be described hereinafter with reference to the drawings.

An ink jet head of the present embodiment will be described.

Additionally, as described later, the ink jet head (hereinafter referred to simply as the head) is a unit integrally formed by assembling a plurality of components.

The entire constitution of a head 1 shown in FIG. 1 will first be described generally.

An element substrate 3 (see FIGS. 2 and 3) is bonded onto a base plate 2, and a grooved top plate 4 is bonded onto the substrate, and is then pressed by a pressing member 5.

Moreover, an ink supply unit 6 for supplying ink to the grooved top plate 4 is further disposed on the pressing member, and fixed to the base plate 2.

Figure 4:
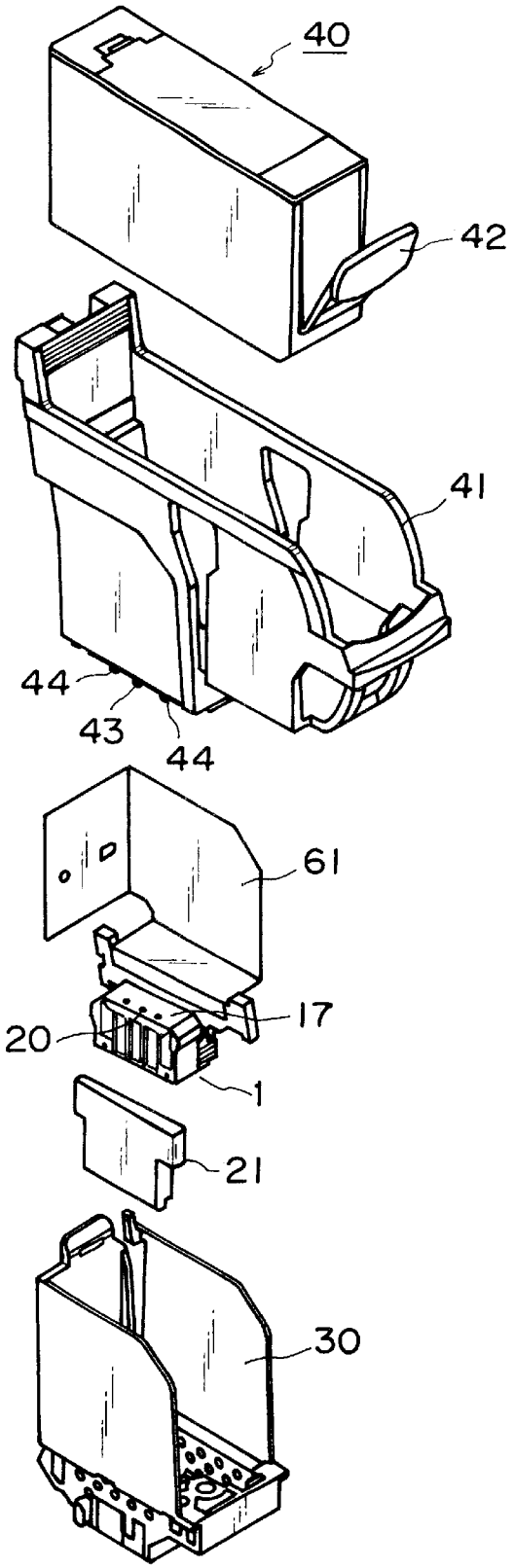
FIG. 4 is a perspective view showing the relation of an ink tank, head-holding member and ink tank holding member according to one embodiment of the present invention.

The rear part of the base plate 2 is bonded to a wiring board 7 which is connected to a flexible cable 61 (see FIG. 4).

Figure 2:
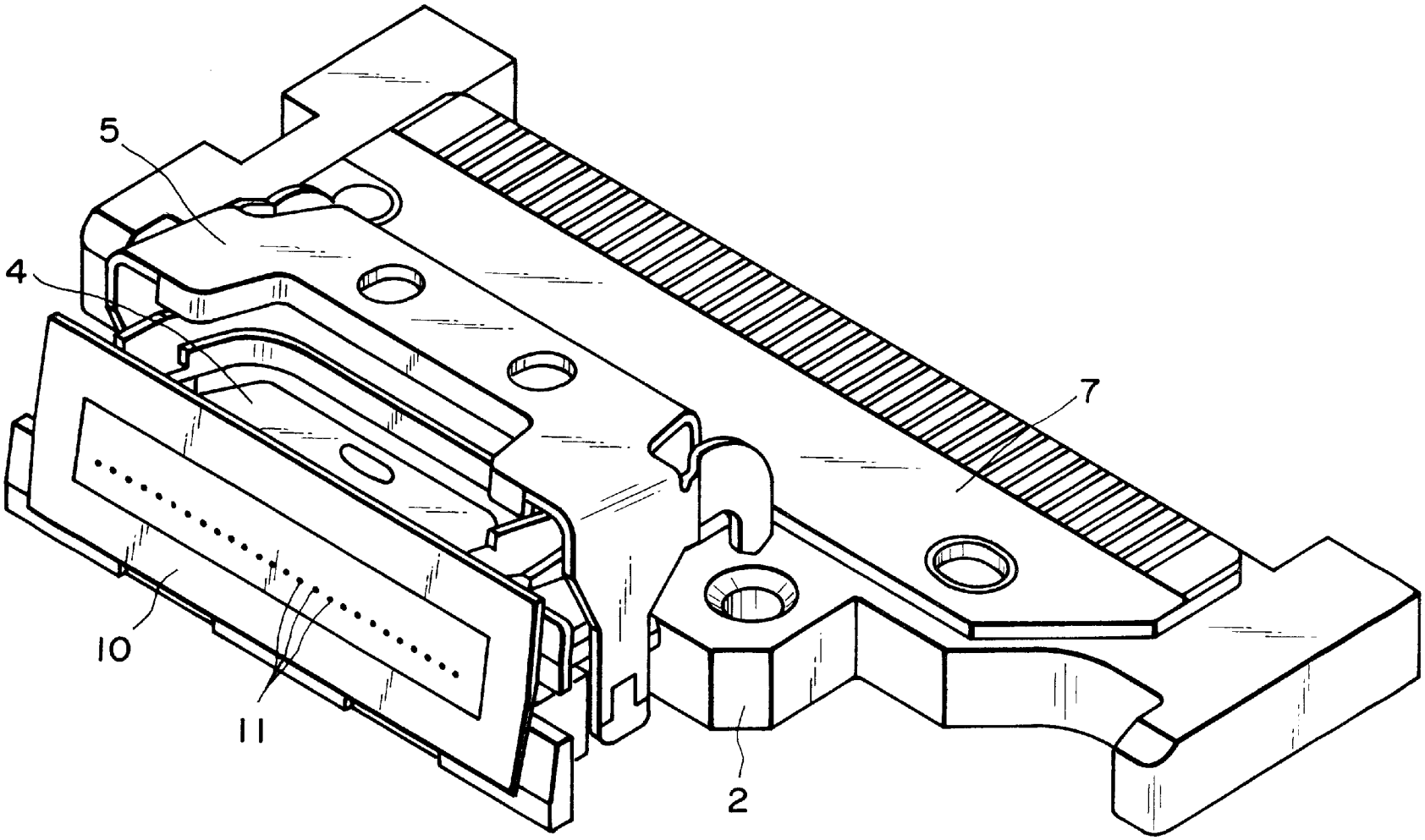
FIG. 2 is a perspective view of the ink jet head shown in FIG. 1 from which an ink supply unit is omitted.
Figure 3:
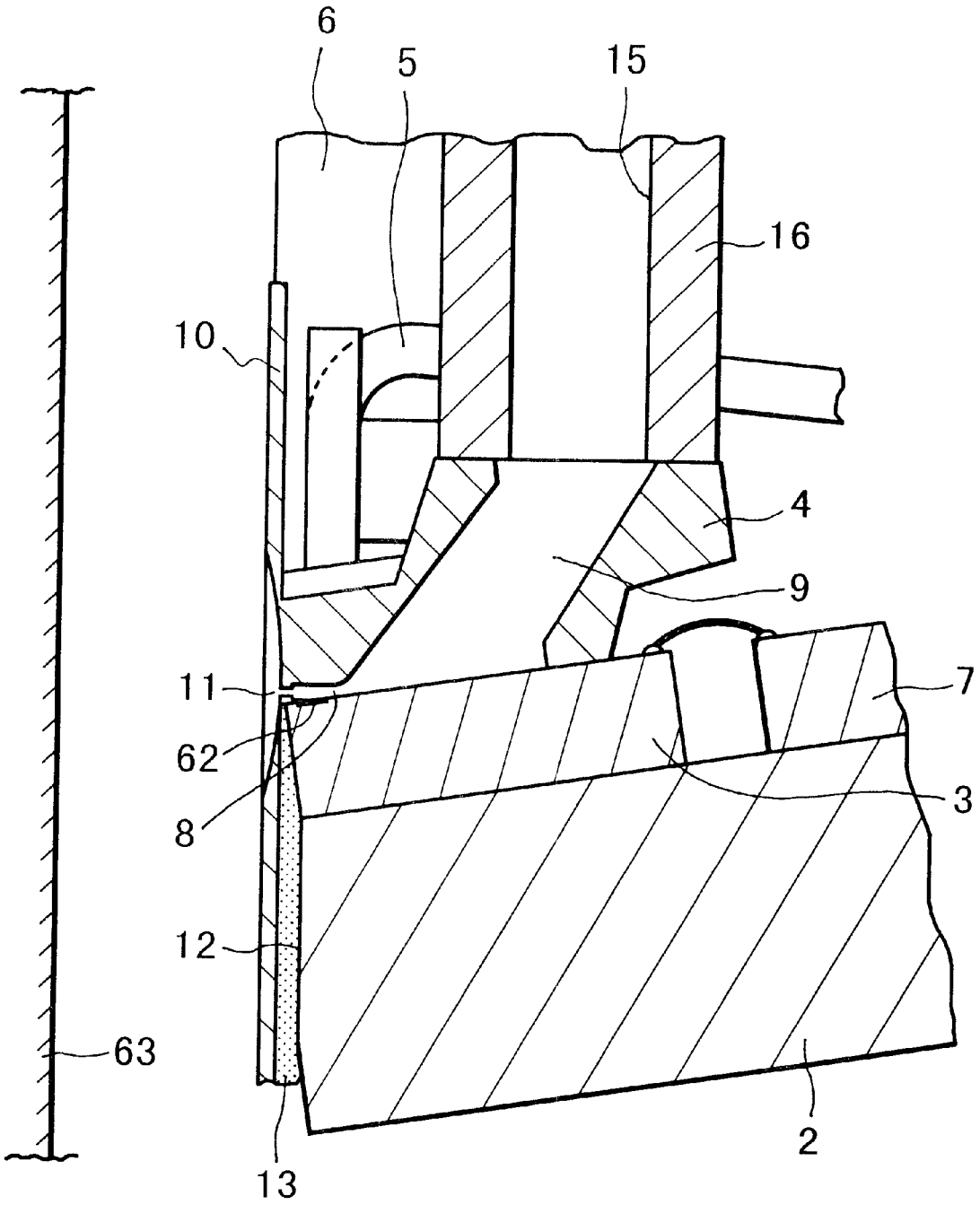
FIG. 3 is a sectional view of the ink jet head shown in FIG. 1.

FIG. 2 shows that the ink supply unit is removed from FIG. 1, and FIG. 3 is a sectional view of the head 1 of FIG. 1.

The constitution of the head 1 will be described in more detail with reference to FIGS. 2 and 3.

One surface (the lower surface in FIG. 2) of the element substrate 3 is bonded to the base plate 2, and the other surface (the upper surface in FIG. 2) is provided with a plurality of energy generating elements 62 (see FIG. 3).

The energy generating element 62 of the present embodiment is a heating element.

The grooved top plate 4 is provided with a groove to form an ink flow path 8 and a hollow to form a common liquid chamber 9 for communicating with the groove in a positional relation such that a plurality of energy generating elements 62 on the element substrate 3 can be connected (see FIG. 3).

When the element arrangement surface of the element substrate 3 is bonded to the groove forming surface of the grooved top plate 4, a plurality of ink flow paths 8 are formed on the bond surface.

Furthermore, an orifice plate 10 is integrally formed on the grooved top plate 4, and is provided with a plurality of fine discharge ports (orifices) 11 which communicate with the ink flow path 8.

Additionally, the center axis of the discharge port 11 is inclined by about ten degrees with respect to the flow direction of the ink flow path 8.

Moreover, the base plate 2, element substrate 3 and ink flow path 8 are all disposed substantially parallel to one another.

Therefore, when the entire surface of the orifice plate 10 is inclined by about 80 degrees with respect to the entire surface of the base plate 2 and element substrate 3, the orifice plate is positioned to be substantially vertical to the center axis of the discharge port 11.

As shown in FIG. 3, the surface of the base plate 2 opposite to the back surface of the orifice plate 10 is provided with an inclined part 12 which forms substantially the same inclination angle as that of the orifice plate 10.

Therefore, a silicon layer 13 for protecting the orifice plate 10 can be disposed in a gap between the element substrate 3 and base plate 2 and the orifice plate 10.

The silicon layer 13 is formed by injecting a silicon agent toward the back surface of the orifice plate 10 from silicon agent injection ports (not shown) disposed in opposite side parts of the grooved top plate 4, and then solidifying the agent.

Additionally, the base plate 2 is fixed to the element substrate 3 by a thermally conductive adhesive in a positional relation such that the gap between the orifice plate 10 and the inclined part 12 of the base plate 2 is about 0.1 mm.

The ink supply unit 6 is provided with an ink flow inlet tube 16 to form an ink flow inlet path 15 which communicates with the common liquid chamber 9.

In the present embodiment, three sets of the ink flow inlet paths 15 and ink flow inlet tubes 16 are formed, but the head with three-color inks used therein is supposed in this form, and this form does not bind the present invention.

In the present invention, only the middle ink flow inlet path 15 and ink flow inlet tube 16 are used.

Additionally, the ink flow inlet tube 16 of the ink supply unit 6 is L-shaped.

Moreover, the ink flow inlet tube 16 is connected to the grooved top plate 4 by filling the periphery of the ink flow inlet 16 pressed onto the grooved top plate 4 with the silicon agent and solidifying the agent (not shown).

Additionally, in order to press the ink flow inlet tube 16 onto the grooved top plate 4, an elastic material is used in the ink flow inlet tube 16.

The ink supply unit 6 is provided with an enclosure part 18 to surround the periphery of the orifice plate 10, and this enclosure part 18 protects the orifice plate 10 from a friction force by a wiper for cleaning the surface of a recording device (not shown), an external force from a side surface, and the like.

The enclosure part 18 is substantially parallel to the orifice plate 10, and inclined by about 80 degrees with respect to the element substrate 3.

Therefore, the enclosure part 18 becomes parallel to a record sheet 63, and the interval between both can be reduced.

One surface of the ink supply unit 6 (the top surface of FIG. 1) is substantially vertical to the orifice plate 10 and a record sheet surface, and inclined by about ten degrees with respect to the base plate 2, element substrate 3, and ink flow path 8.

Therefore, a space for containing the ink flow inlet tube 16 is secured in the ink supply unit 6.

Moreover, the top surface of the ink supply unit 6 is provided with an edge 19 for scraping off a thickened ink adhering to the wiper.

Figure 26B:
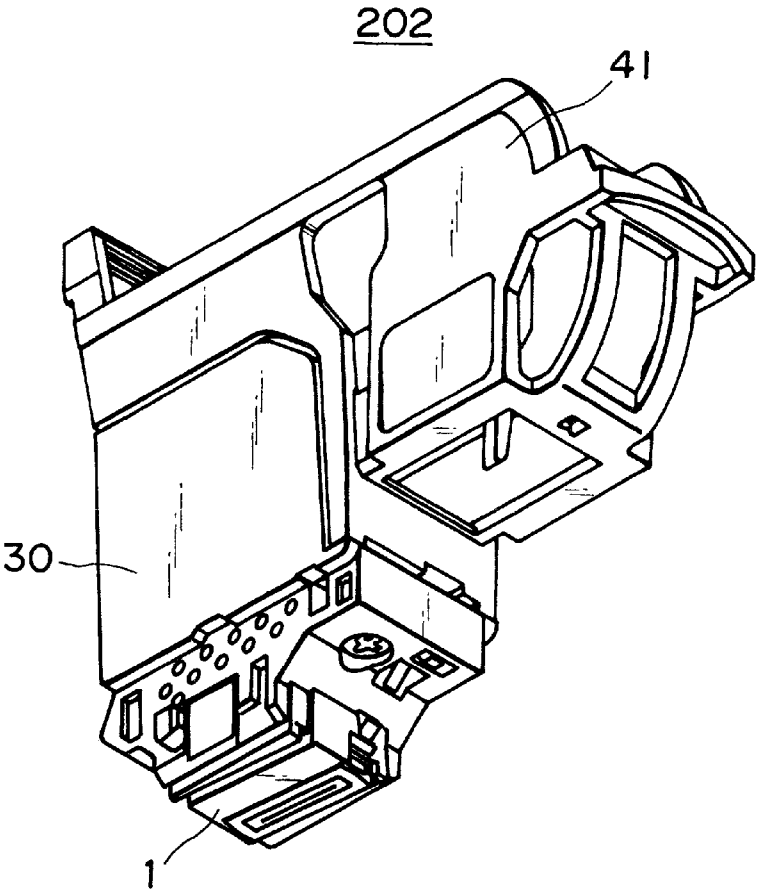
FIGS. 26A and 26B show the relation of the ink tank, head holding member and ink tank holding member according to one embodiment of the present invention.
Figure 26A:
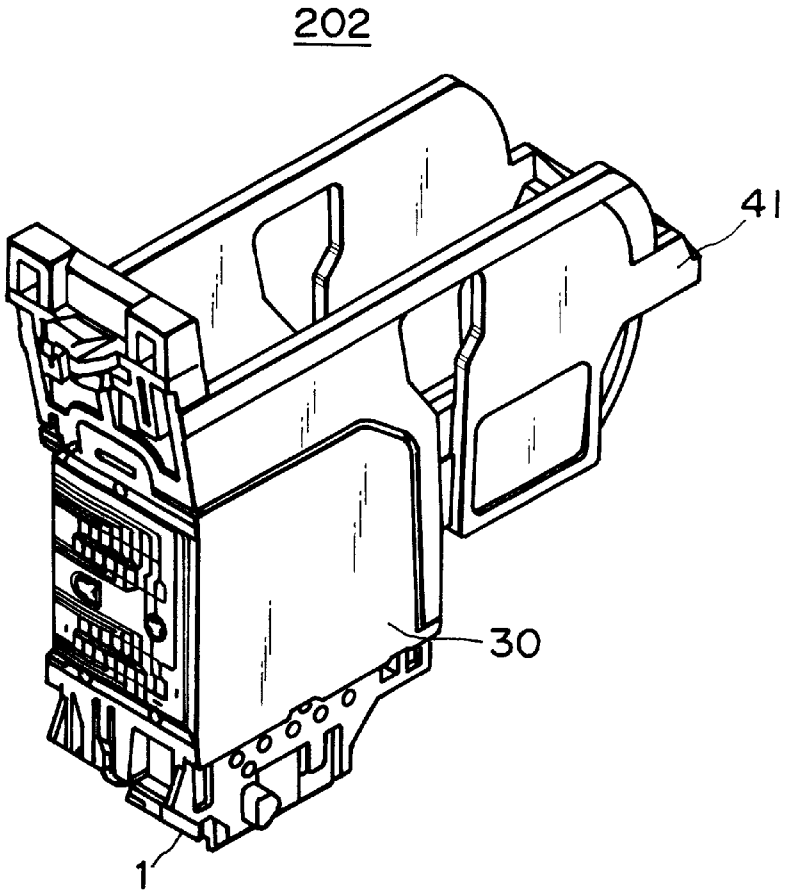
Figure 27:
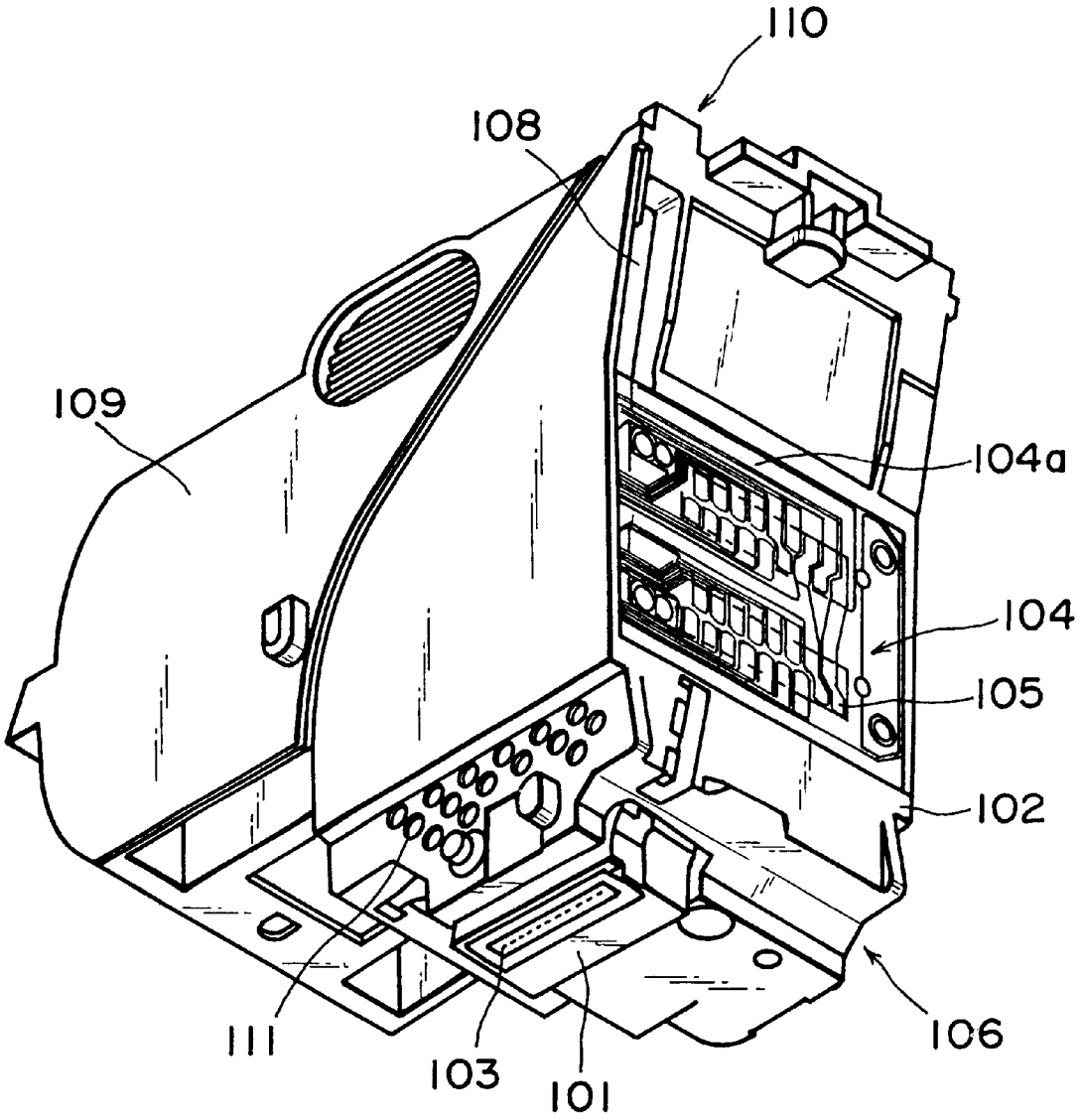
FIG. 27 PRIOR ART
FIG. 27 is a perspective view showing one example of a conventional ink jet cartridge.
Figure 28:
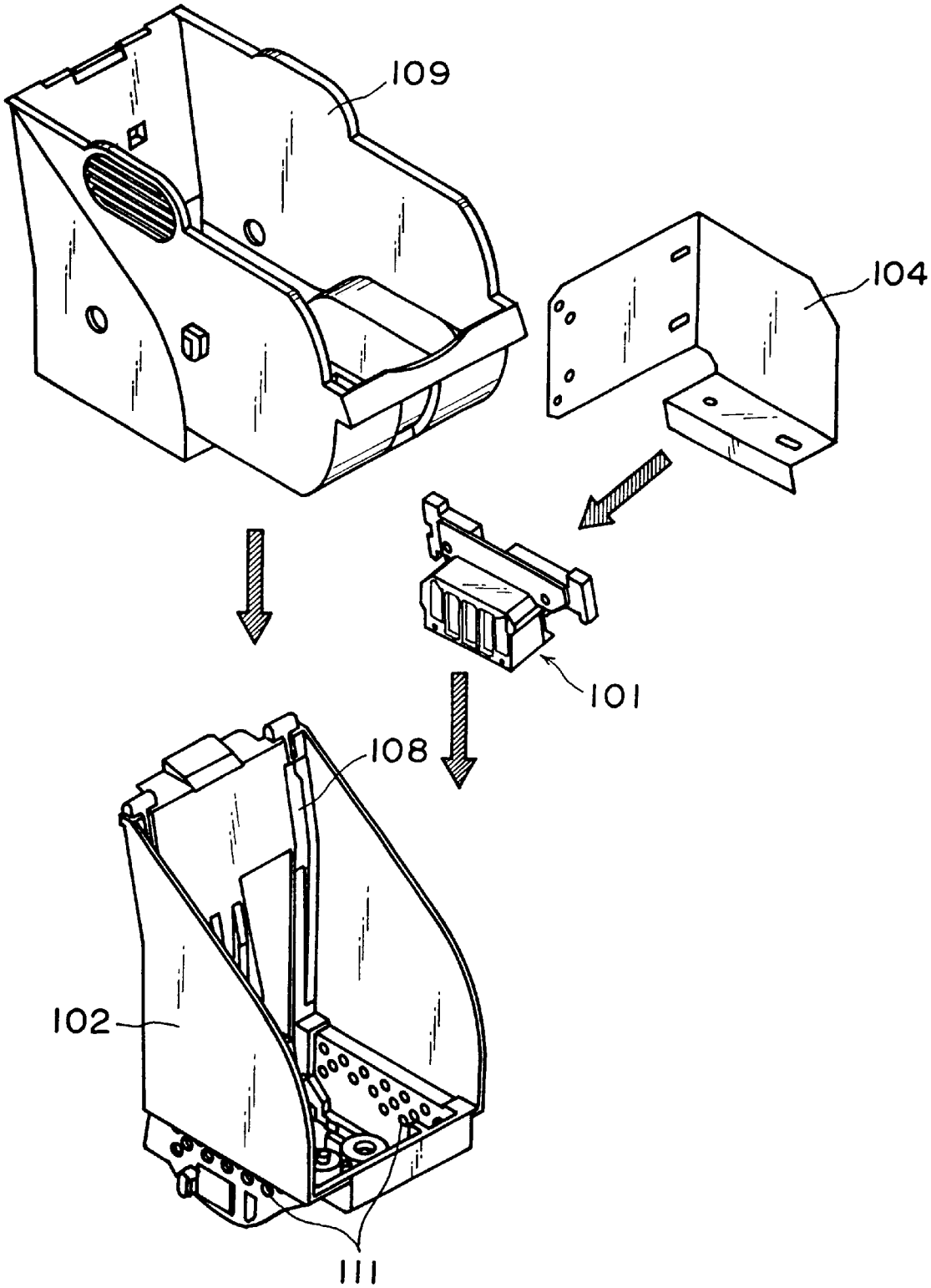
FIG. 28 PRIOR ART
FIG. 28 is a perspective view showing that the ink jet cartridge shown in FIG. 27 is exploded.

The head 1 constituted as described above is held between a head holding member 30 and an ink tank holding member 41 as shown in FIGS. 4, 26A, 26B and is thereby attached to an ink jet cartridge.

Figure 10:
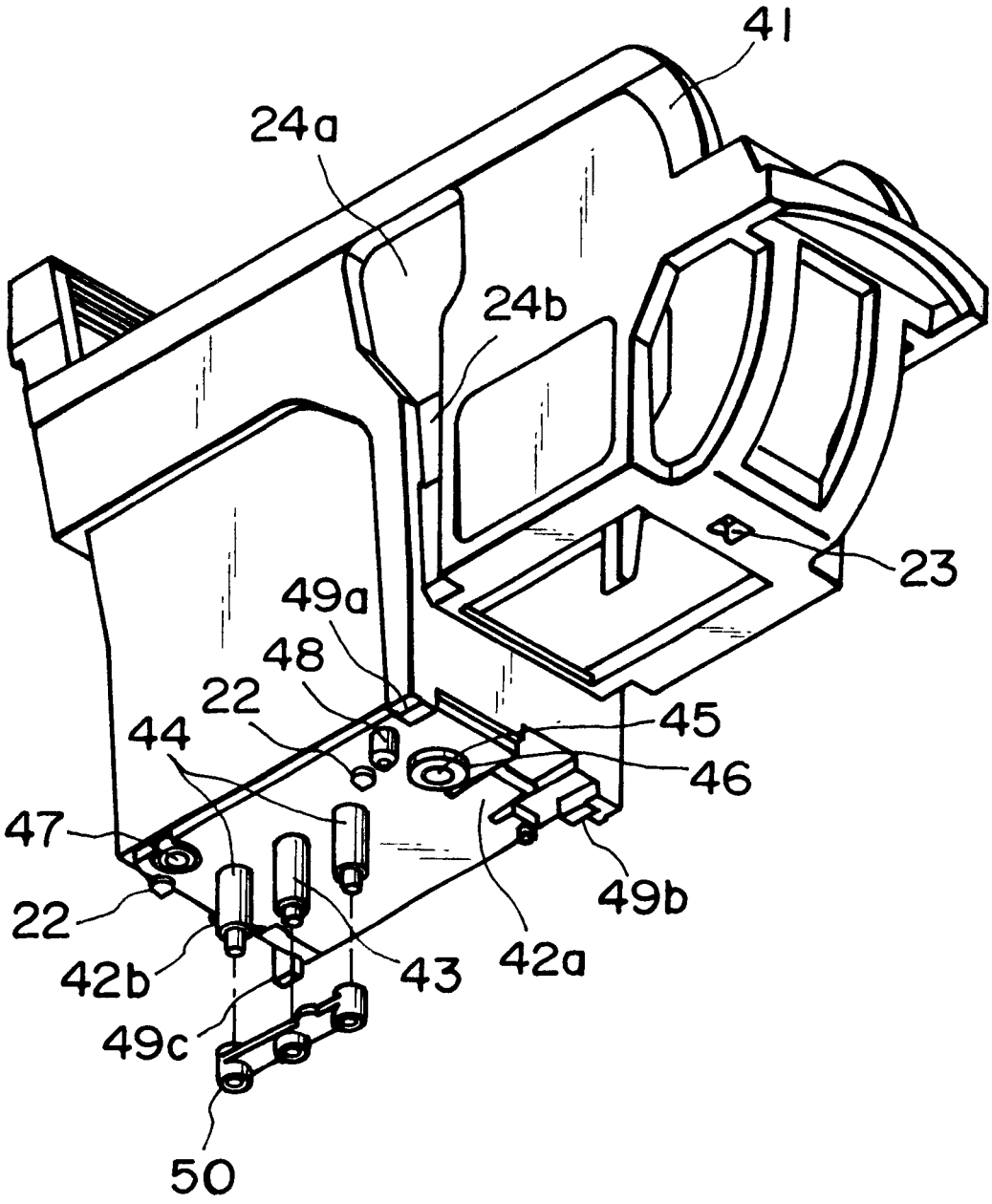
FIG. 10 is a perspective view showing the ink tank holding member and elastic member according to one embodiment of the present invention.
Figure 11:
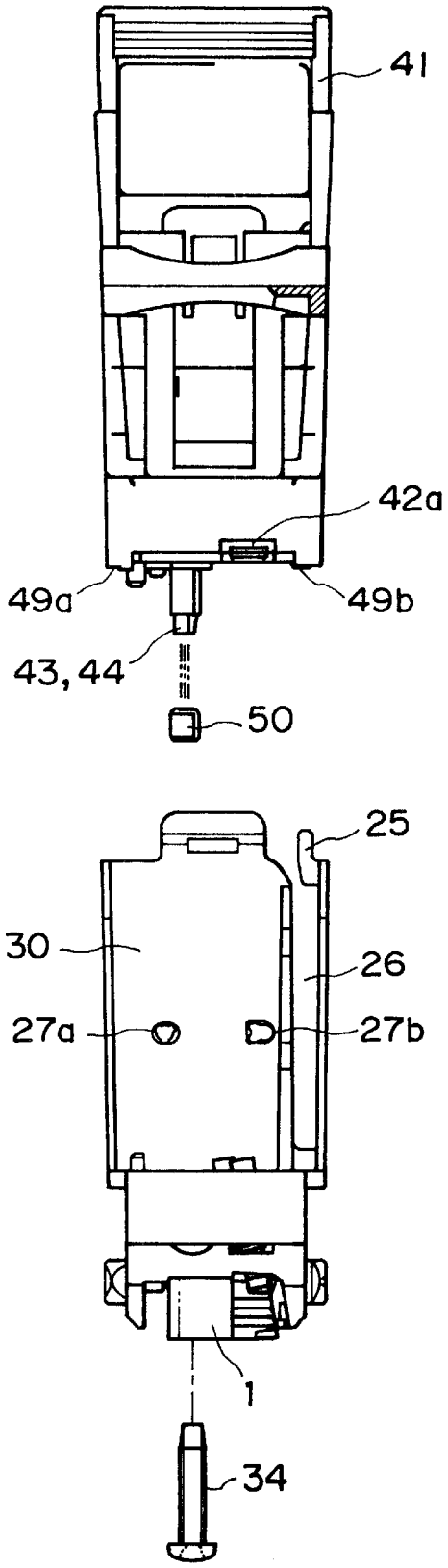
FIG. 11 is an explanatory front view showing a method of connecting the head holding member to the ink tank holding member according to one embodiment of the present invention.

Moreover, an ink supply tube 43 of the ink tank holding member 41 is pressed onto an ink flow inlet port flat part 17 of the head 1 via an elastic member 50 (see FIG. 10). Furthermore, the head 1 is elastically supported by the head holding member 30 and ink tank holding member 41 by the force applied from a vertical direction via the elastic member 50 by an ink supply tube 43 and a bond pressing pillar 44 protruded from the ink tank holding member 41 with respect to the ink flow inlet flat part 17 in which an ink flow inlet port 20 of the ink supply unit 6 is positioned.

In the ink jet cartridge assembled in this manner, the ink is supplied to the discharge ports 11 from an ink tank 40 successively via the ink supply tube 43, a communication hole 51 of the elastic member 50, the ink flow inlet port 20, the ink flow inlet tube 16, the common liquid chamber 9, and the ink flow path 8, the energy generating element 62 is driven, and the ink is then discharged toward the record sheet 63 outside from the discharge ports 11.

Figure 5:
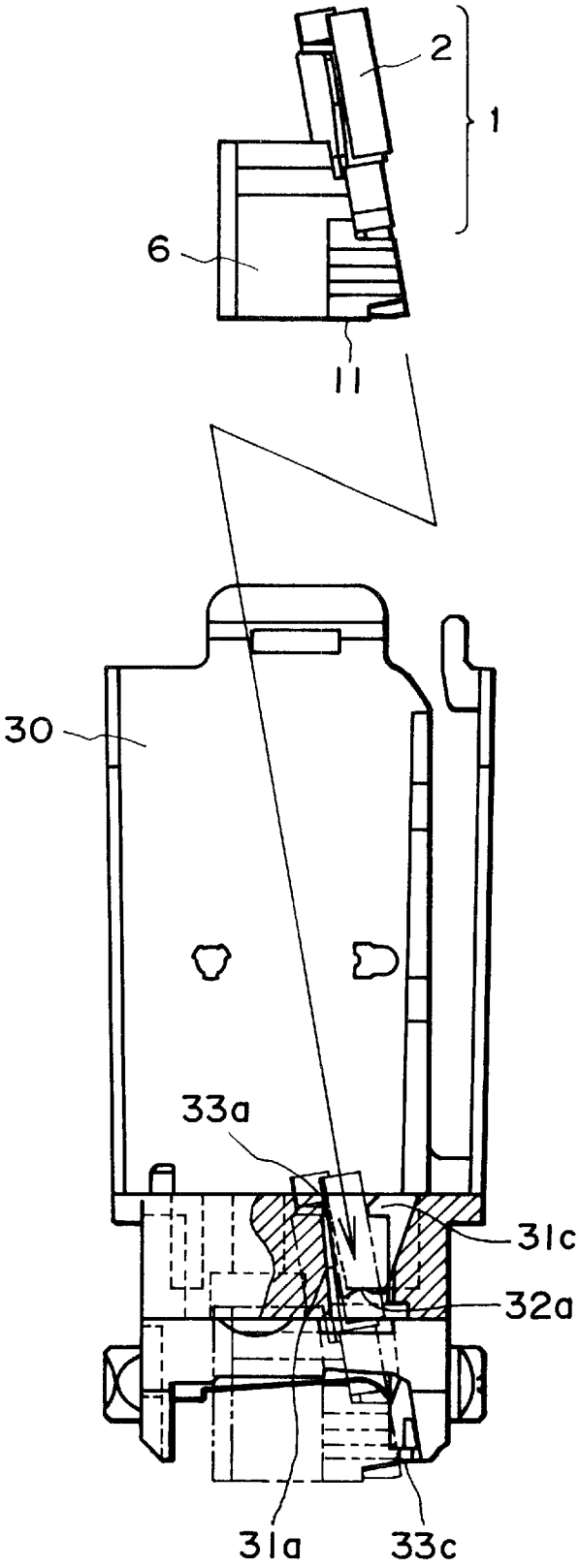
FIG. 5 is an explanatory view showing a method of connecting the ink jet head to the head holding member according to one embodiment of the present invention.
Figure 6:
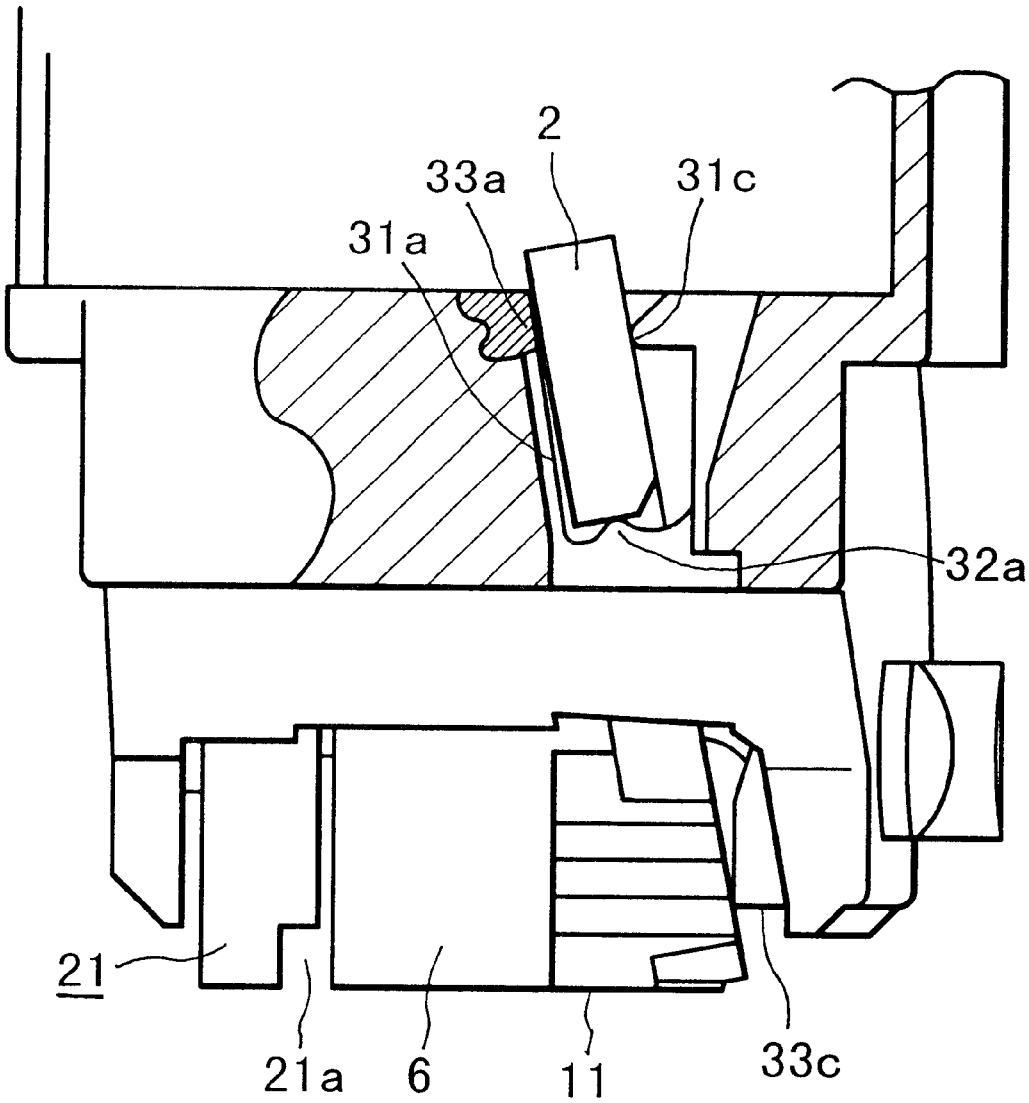
FIG. 6 is an enlarged view of the main part showing an ink jet head fixing part according to one embodiment of the present invention.
Figure 8:
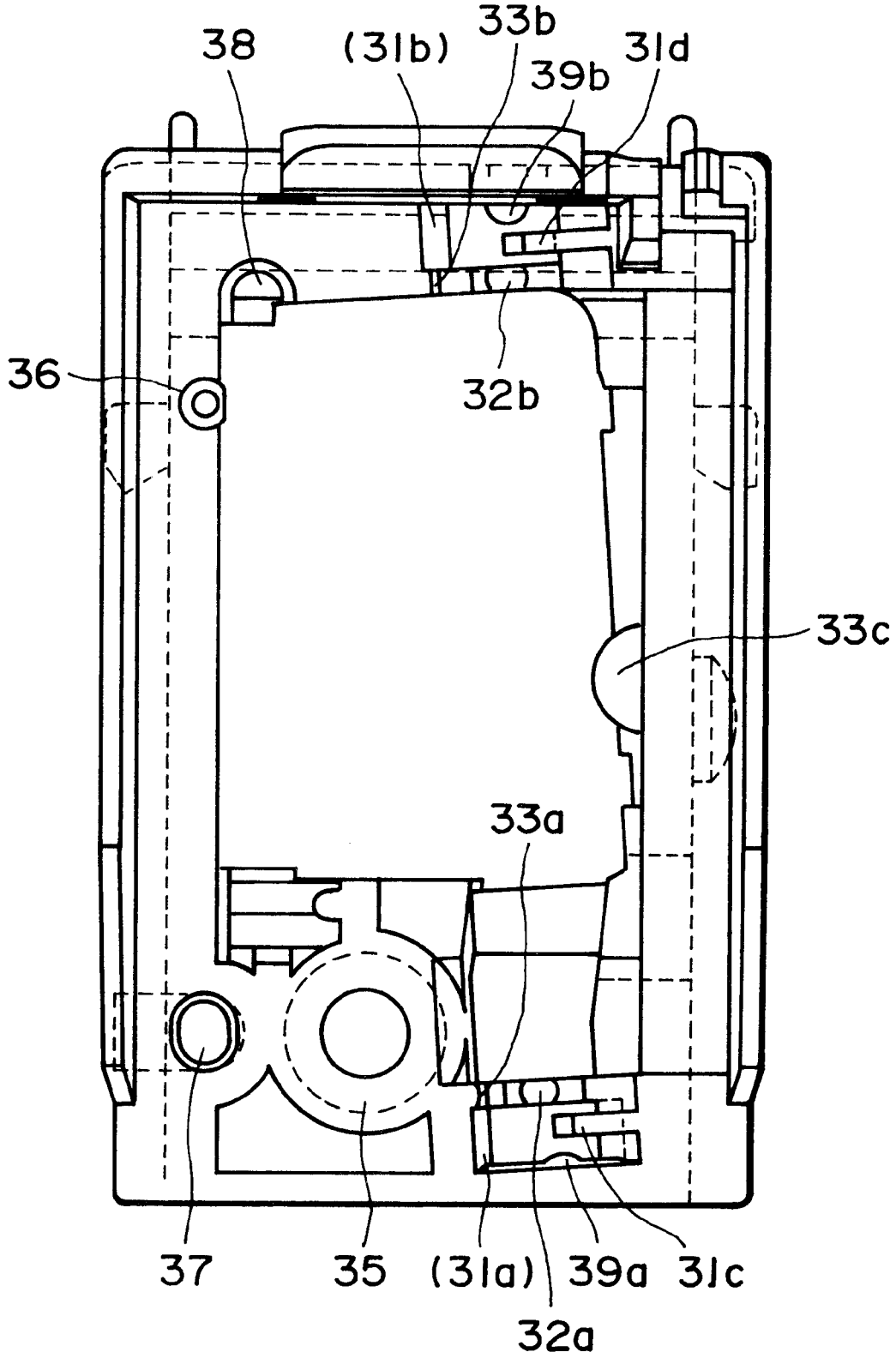
FIG. 8 is an inner surface view of the head holding member for holding the ink jet head according to one embodiment of the present invention.

As shown in FIGS. 5, 6, and 8, a head insertion space for inserting the base plate 2 is disposed inside the head holding member 30, head insertion guides 31*a* and 31*c*, 31*b* and 31*d* are disposed on both sides of the space, and head support parts 32*a*, 32*b* are disposed in the bottom part of the head insertion space to determine the protruding amount of the head 1 from the head holding member 30.

Moreover, the head insertion space is inclined with respect to the insertion direction of the ink tank holding member into the head holding member 30. When the base plate 2 is guided and inserted into the space, the base plate 2 abuts on the head support part 32*a*, 32*b* and its movement in the insertion direction of the base plate 2 is regulated. When the head is further pressed by the pressing force of the elastic member 50, the head starts its rotating movement using the head support parts 32*a*, 32*b* as support points. In this case, the ends of the head insertion guides 31*a*, 31*b* are provided with head receiving parts 33*a*, 33*b* which also determine the rotation position of the head.

Furthermore, the head holding member 30 is provided with a head receiving part 33*c* in substantially symmetric positions of the back surface of the base plate centering on a rotation axis with respect to the head receiving parts 33*a*, 33*b*, so that a rotation moment is efficiently utilized.

Additionally, these head receiving parts 33*a*, 33*b* and head receiving part 33*c* are disposed on the surface and back surface of the base plate so that the positions from the surface direction of the base plate 2 are in a relation to form a substantial isosceles triangle, and the pressure can be dispersed as uniformly as possible.

Moreover, the head support parts 32*a*, 32*b*, and head receiving parts 33*a*, 33*b*, 33*c* have an R-shaped section in order to minimize a contact area with respect to the base plate 2. Specifically, the base plate 2 is supported by a point in the constitution.

Furthermore, the surface by which the base plate is supported is univocally defined by the three-point support of the head.

In the constitution, the head holding member 30 receives the pressing force from the elastic member 50 by the head support parts 32*a*, 32*b*, and head receiving parts 33*a*, 33*b*, 33*c*, and the head 1 is elastically supported in a positional relation in which the surface of the orifice plate 10 is kept to be parallel to the surface of the record sheet 63.

The direction of a force exerted to hold the head 1 will be described with reference to FIGS. 7A and 7B.

Figure 7A:
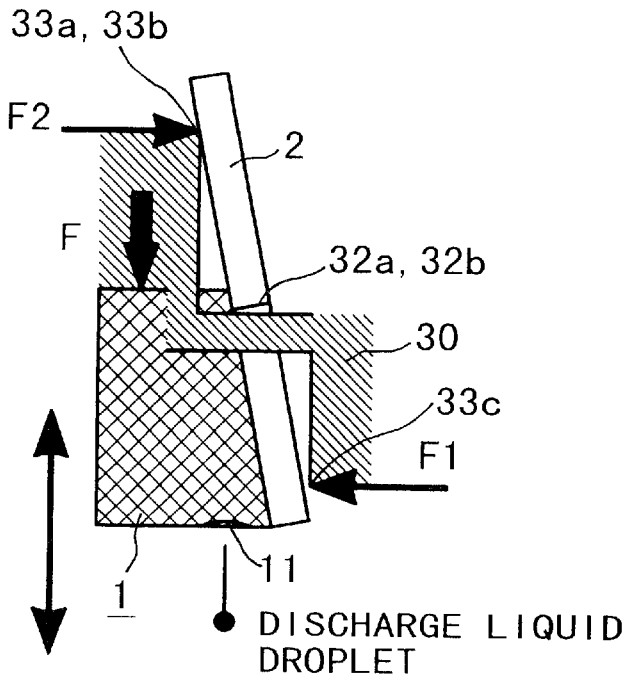
FIGS. 7A and 7B are schematic explanatory views showing a method of fixing the ink jet head according to one embodiment of the present invention.
Figure 7B:
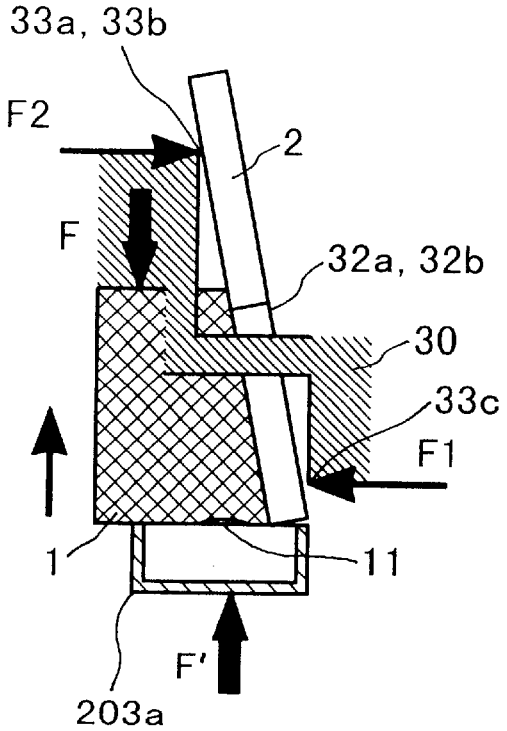

In FIGS. 7A and 7B, an arrow F indicates the pressing force of the elastic member. Upon receiving the pressing force F, the head 1 performs its rotating movement in a counterclockwise direction, the rotating movement is regulated by the head receiving parts 33*a*, 33*b*, 33*c*, and forces shown by arrows F1, F2 are generated in a direction intersecting the arrow F to fix the head 1.

Since the base plate 2 is inclined in this manner, the regulation in the intersecting direction can simultaneously be performed by the force of the elastic pressing direction (the force of the arrow F). In the constitution of the present invention in which the head 1 is self-aligned by the elastic force in this manner, the head 1 can highly precisely and easily be positioned as long as only the precision of the head support part and head receiving parts 33*a*, 33*b*, 33*c* is high.

Furthermore, as shown in FIG. 7B, in the ink jet cartridge of the present constitution, during the capping of the surface of the head 1 provided with the discharge ports 11 (the surface of the orifice plate 10), since the head 1 can move with respect to the abutment direction F' of a cap 203*a* by the elastic force of the elastic member, the cap abutment force can finely be adjusted. Moreover, during the movement, since the angle of the surface of the orifice plate 10 is regulated by the head receiving parts 33*a*, 33*b*, 33*c* and is unchanged, the abutment force of the cap 203*a* (see FIG. 18) is prevented from being non-uniform.

Moreover, as shown in FIG. 8, in the positions of the head holding member 30 opposite to both side surfaces of the base plate 2, head side receiving parts 39*a*, 39*b* are disposed, and one head side receiving part 39*b* is formed as a leaf spring.

Thereby, the discharge port arrangement direction of the head 1 is positioned.

Additionally, the sections of the head side receiving parts 39*a*, 39*b* are also R-shaped similarly as the head support parts 32*a*, 32*b* and head receiving parts 33*a*, 33*b*, 33*c*.

Moreover, the head holding member 30 is also provided with a wiper cleaner insertion guide for inserting a wiper cleaner 21 formed of a hydrophilic porous plastic material described later (see FIGS. 4, 6). When the wiper cleaner 21 is fitted in the wiper cleaner insertion guide, the movement amount of the head in the rotation direction is regulated during the connecting of the head holding member to the ink tank holding member.

Furthermore, the inner surface of the head holding member 30 is provided with an engagement pin 36 and engagement hole 37 disposed also to position and fix the head holding member 30 to the ink tank holding member 41, and a cylindrical part 35 into which a fixing screw 34 (not shown) for fixing the head holding member 30 to the ink tank holding member 41 can be inserted.

The ink tank 40 and ink tank holding member 41 shown in FIG. 4 will next be described.

In the present embodiment, the use of one ink tank 40 is supposed.

This ink tank 40 is attached to the ink tank holding member 41 which is fixed to the head holding member 30.

Additionally, the ink tank 40 is detachable/attachable with respect to the ink tank holding member 41 by the operation of a lever 42.

The ink tank holding member 41 is provided with an outer shape which can be mounted inside the head holding member 30.

Figure 9:
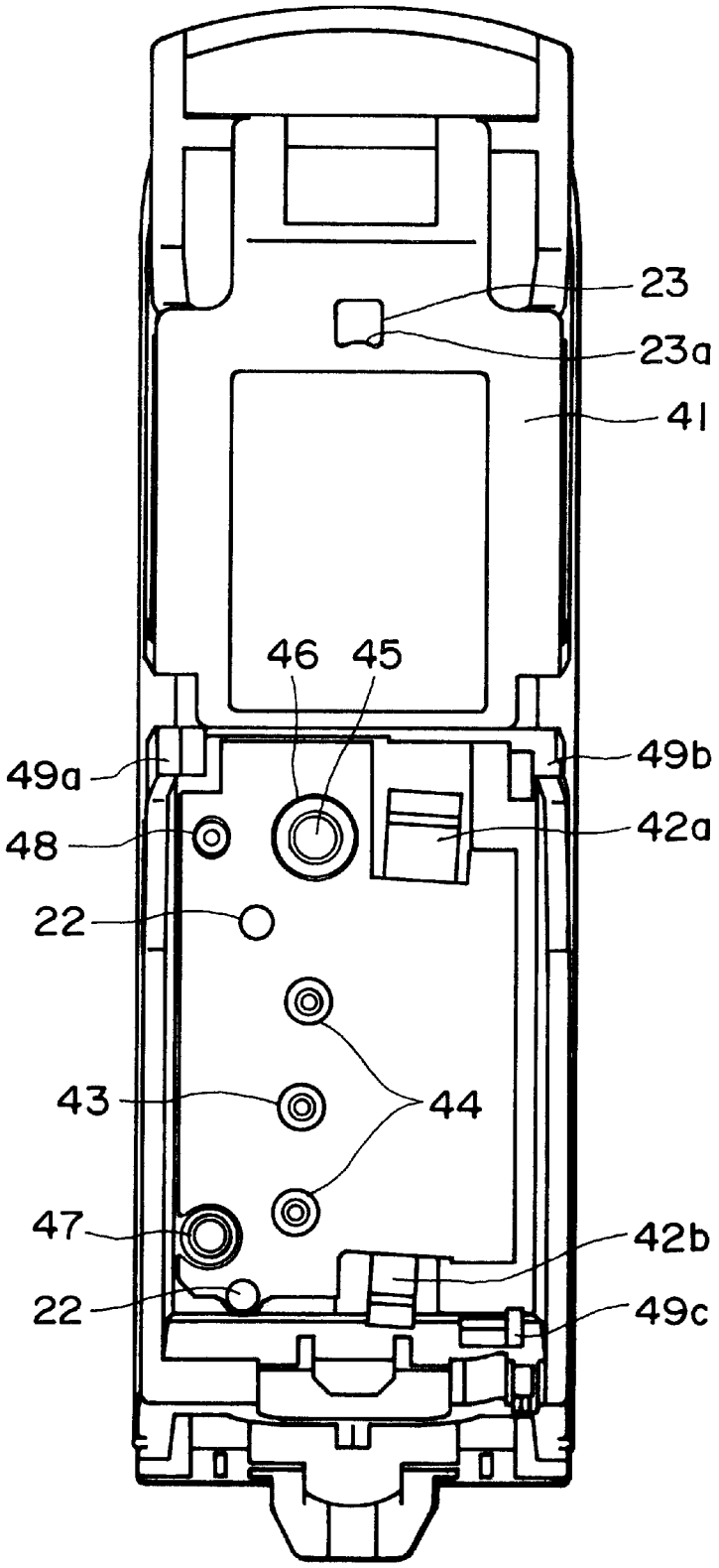
FIG. 9 is a bottom plan view of the ink tank holding member according to one embodiment of the present invention.

As shown in FIGS. 9 and 10, disposed on the bottom surface of the ink tank holding member 41 are one ink supply tube 43 communicating with the ink tank 40 so that the ink can be discharged, two bond pressing pillars 44 arranged in series with the ink supply tube 43, a cylindrical part 46 provided with a screw hole 45 into which the screw 34 (not shown) is inserted, an engagement part 47 and engagement recess 48 necessary for the bonding to the engagement pin 36 and engagement hole 37 of the head holding member 30, support parts 49*a*, 49*c* for supporting the head holding member 30, leaf springs 42*a*, 42*b* for supporting the base plate 2, a wiper cleaner fixing pin 22 for fixing the wiper cleaner 21, and the like.

Moreover, a tank pin engagement hole 23 for engaging with a tank pin (not shown) disposed on the bottom of the ink tank 40 is disposed on the bottom surface on the ink tank attachment side of the ink tank holding member 41. The tank pin engagement hole 23 has a substantially square shape and is provided with a protrusion 23*a* protruded from the head attachment side, and the position precision during the engagement of the tank pin is enhanced by this protrusion.

A structure in which the ink tank holding member 41 for holding the ink tank 40 is bonded to the head holding member 30 for holding the head 1 and wiper cleaner 21 will next be described with reference to FIG. 11 and FIGS. 12A to 12C.

As shown in FIGS. 12A to 12C, when the bottom surface of the ink tank holding member 41 is inserted into the head holding member 30, the support parts 49*a*, 49*b*, 49*c* abut on the bottom inside the head holding member 30, which determines the insertion amount of the ink tank holding member 41.

Moreover, the engagement part 47 and engagement recess 48 are disposed opposite to the engagement hole 37 and engagement pin 36 of the head holding member 30, respectively, and the bottom surface is positioned by the engagement of these components during the inserting of the ink tank holding member. The ink supply tube 43 is thus guided and positioned opposite to the ink flow inlet tube 16 of the head 1.

Furthermore, the cylindrical part 46 abuts on the cylindrical part 35 of the head holding member 30 to form a continuous cylindrical shape. When the screws 34 are inserted into the cylindrical parts 35, 46, the head holding member 30 is fixed to the ink tank holding member 41.

Here, as means for fixing the head holding member 30 to the ink tank holding member 41, welding or lock mechanism may be used instead of the screw 34, or the screw 34 can be fixed with an adhesive or a silicone agent, but by using only the screw 34 to fix the members as in the present embodiment, there are advantages that the attachment/detachment is facilitated, the reuse of components, the development of a separate unit, and other uses are facilitated, the structure is simplified and that the cost can be reduced.

Additionally, the cylindrical part 46 as the fixing part of the head holding member to the ink tank is disposed in the area surrounded with the support parts 49*a*, 49*b*, 49*c*, and the forces applied to the respective support parts can be dispersed as uniformly as possible.

Moreover, two bond pressing pillars 44 have substantially the same height as that of the ink supply tube 43, and the ink supply tube 43 and bond pressing pillars 44 are disposed outside the area (triangular area) surrounded with the support parts 49*a*, 49*b*, 49*c*.

Furthermore, the leaf springs 42*a*, 42*b* are disposed so that the force is equally applied to the base plate 2.

In this case, the leaf springs 42*a*, 42*b* apply a constant force to the base plate 2 to support the head 1.

Moreover, the wiper cleaner fixing pin 22 is shaped to abut on the wiper cleaner 21.

FIGS. 12B and 12C are enlarged views of the elastic member 50.

In the present embodiment, the elastic member 50 is disposed on the part of the ink supply tube 43 and bond pressing pillars 44, and the communication hole 51 is disposed in the part held between the ink supply tube 43 and the ink flow inlet port 20.

Additionally, no communication hole is necessary in the part held between the bond pressing pillar 44 and the ink flow inlet flat part 17 of the ink supply unit 6.

Moreover, during the molding of the ink tank holding member 41, the bond pressing pillar 44 with a tubular shape similar to that of the ink supply tube 43 may be formed by molding the pillar simultaneously with the ink supply tube 43.

Specifically, this bond pressing pillar 44 is a so-called dummy ink supply tube.

In this case, it is necessary to make no hole in the part of the elastic member 50 opposite to the bond pressing pillar 44 as the dummy ink supply tube.

Furthermore, for the thickness of the elastic member 50, a thickness t1 of the part opposite to the bond pressing pillar 44 is larger than a thickness t2 of the part opposite to the ink supply tube 43. In this constitution, since the pressing force for elastically holding the head 1 is generated mainly in the part of the bond pressing pillar 44, the elastic member of the ink supply tube part is prevented from being pressed too strongly, and the communication state of the ink supply tube 43 with the ink flow inlet port 20 is satisfactorily secured.

In FIG. 10, the ink tank holding member 41 is provided with carriage guides 24*a*, 24*b* which function as guides during the mounting of the ink jet cartridge on a carriage.

In the ink jet apparatus of the present embodiment, as described later with reference to FIGS. 16A to 16E, four-color ink jet cartridges of yellow (Y), magenta (M), cyan (C), and black (BK) can simultaneously be mounted.

Therefore, in order to reduce the width of the carriage in the scanning direction, the carriage guides 24*a*, 24*b* of the present embodiment have a groove shape, and engage with protrusions (not shown) on the top end of a partition plate disposed among the mount parts of the respective cartridges of the carriage.

Moreover, for the groove shapes of the carriage guides 24*a*, 24*b*, since the part 24*b* closer to the bottom surface during the use of the ink tank holding member 41 is formed in a narrow linear shape, the movement of the ink jet cartridge is regulated so that the discharge port surface of the ink jet cartridge is prevented from inadvertently contacting the electric connection part (not shown) of the carriage.

On the other hand, when the protrusion on the carriage side is on the side of the area 24*a* apart from the bottom surface, the discharge port surface of the ink jet cartridge fails to contact the electric connection part of the carriage, and a wide window shape is formed, so that the rotating operation of the ink jet cartridge can smoothly be performed during the final positioning with respect to the carriage.

Moreover, the carriage guides 24*a*, 24*b* are disposed on the thick part of the wall surface constituting the ink tank holding member, which is apart from the part to be attached to the head unit holding member, so that the ink tank can securely be held without deteriorating the rigidity of the ink tank holding member itself.

This can increase the protruding amount of the protrusion on the top end of the partition plate disposed between the respective carriage mount parts of the carriage.

By increasing the protruding amount in this manner, even after the repeated attachment, the inhibition of the function of the protrusion disposed on the carriage by wear can preferably be prevented.

Additionally, the carriage guides 24*a*, 24*b* may be extended either on the bottom surface side of the side surface part or the end of the side opposite to the bottom surface, but in the present embodiment, in order to secure the rigidity of the ink tank holding member itself, the area on the bottom surface side of the carriage guide 24*b* is formed in a recess not passed through the wall surface. Moreover, the top end on the side of the carriage guide 24*a* is not cut out and a frame is left.

From the viewpoint of the inserting operation of the ink jet cartridge, in the initial stage of the insertion, this shape strictly regulates the position of the ink jet cartridge with respect to the carriage scanning direction. Moreover, the frame of the top end in the present embodiment fails to contact the protrusion disposed on the carriage during the rotating operation.

Figure 19:
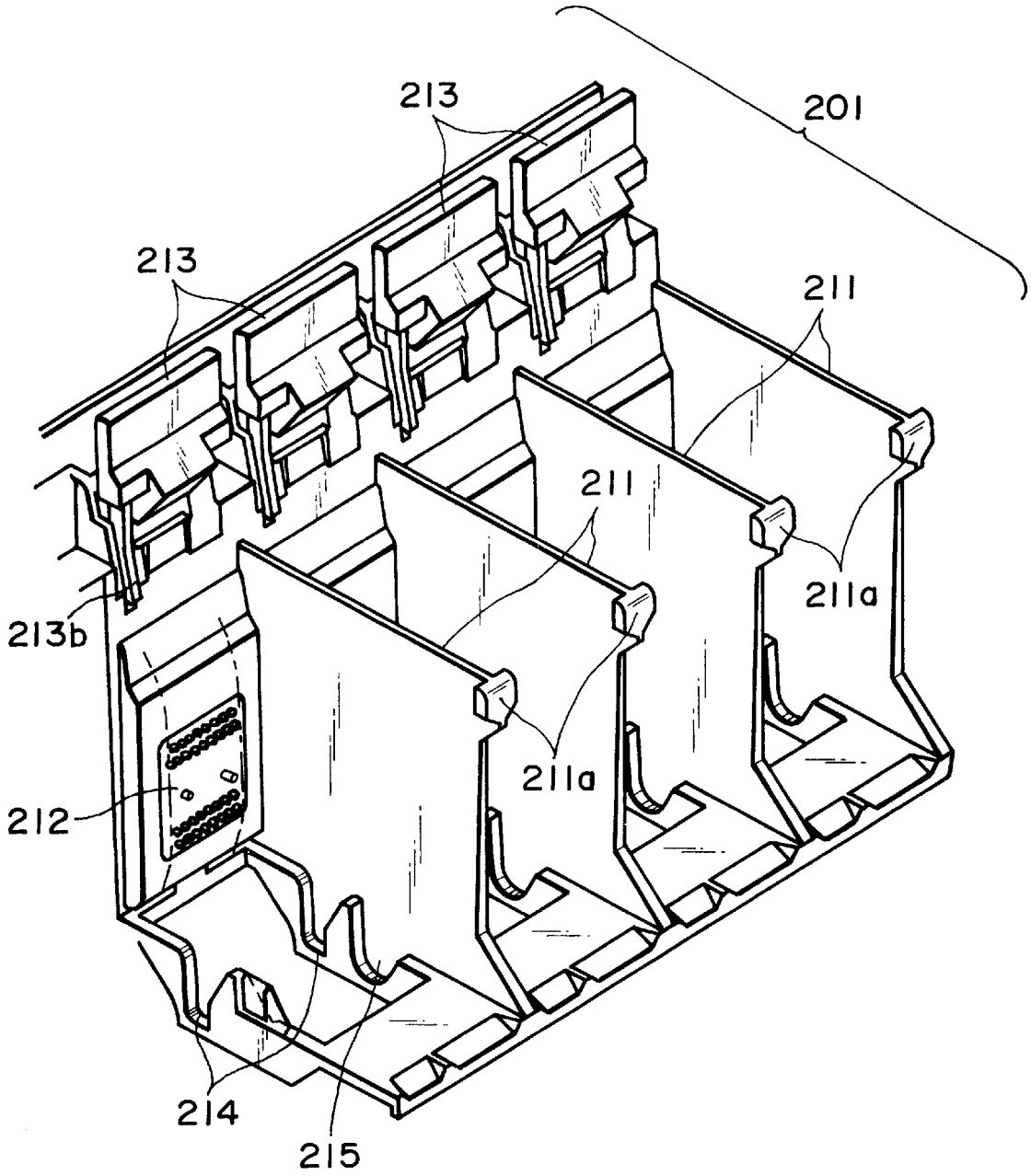
FIG. 19 is a perspective view of a carriage to which the ink jet cartridge of the embodiment of the present invention is detachably attached.

On the other hand, in a carriage 201, as shown in FIG. 19, partition plates 211 are formed substantially parallel to the side surface of an ink jet cartridge 202, and at predetermined intervals with respect to the ink jet cartridge 202, and constitute two surfaces in a space into which the ink jet cartridge 202 is inserted/fixed.

When a plurality of ink jet cartridges 202 are mounted on one carriage 201 as in the present embodiment, the partition plate 211 between the adjacent ink jet cartridges is shared by the respective ink jet cartridges 202.

For each partition plate 211, a protrusion 211*a* provided with a substantially rectangular shape protruded on the ink jet cartridge side (inner side) is formed on a corner on the ink jet cartridge insertion side of the partition plate 211.

Figure 20:
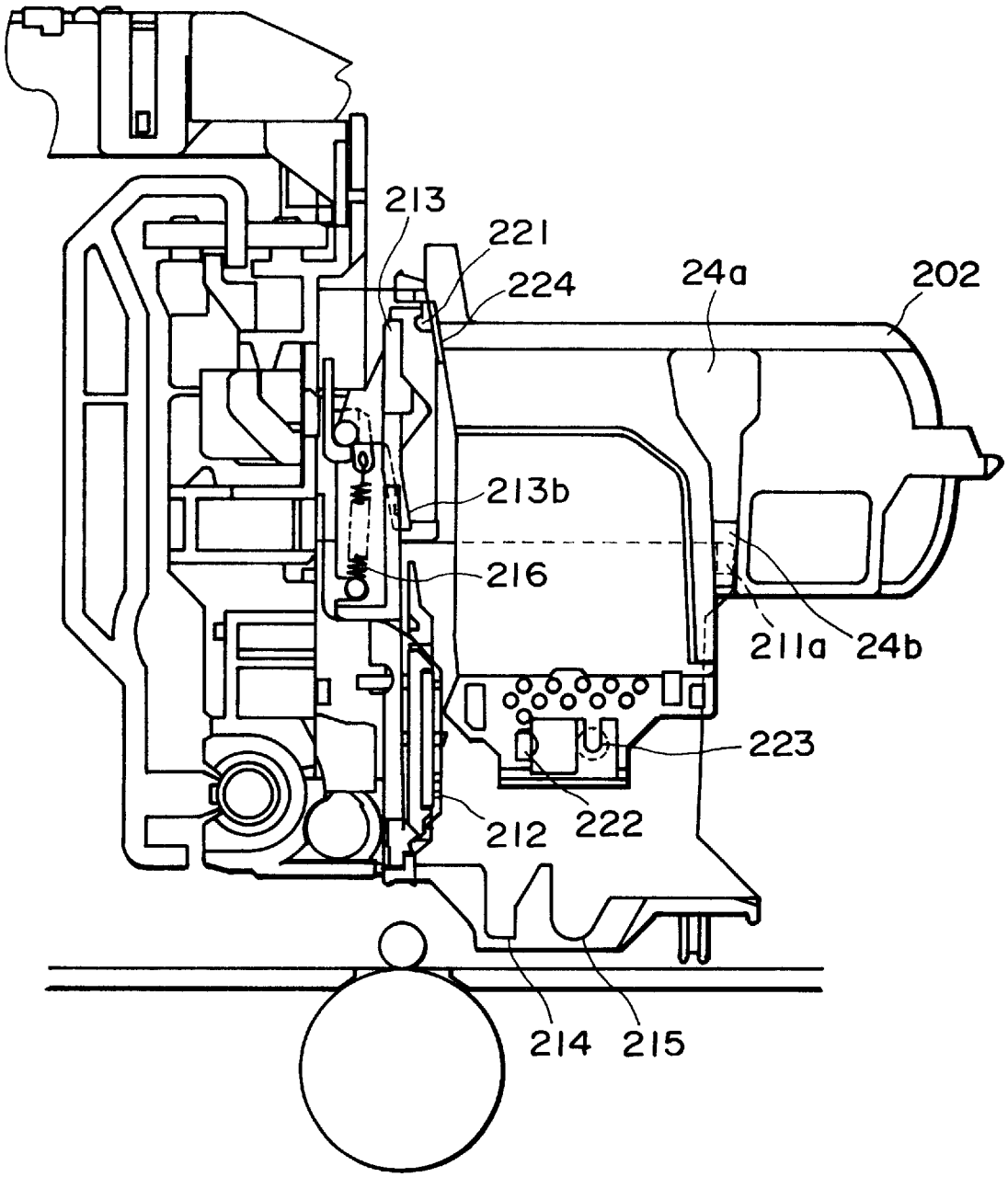
FIG. 20 is an explanatory view showing an operation of inserting the ink jet cartridge into the carriage according to one embodiment of the present invention.
Figure 25:
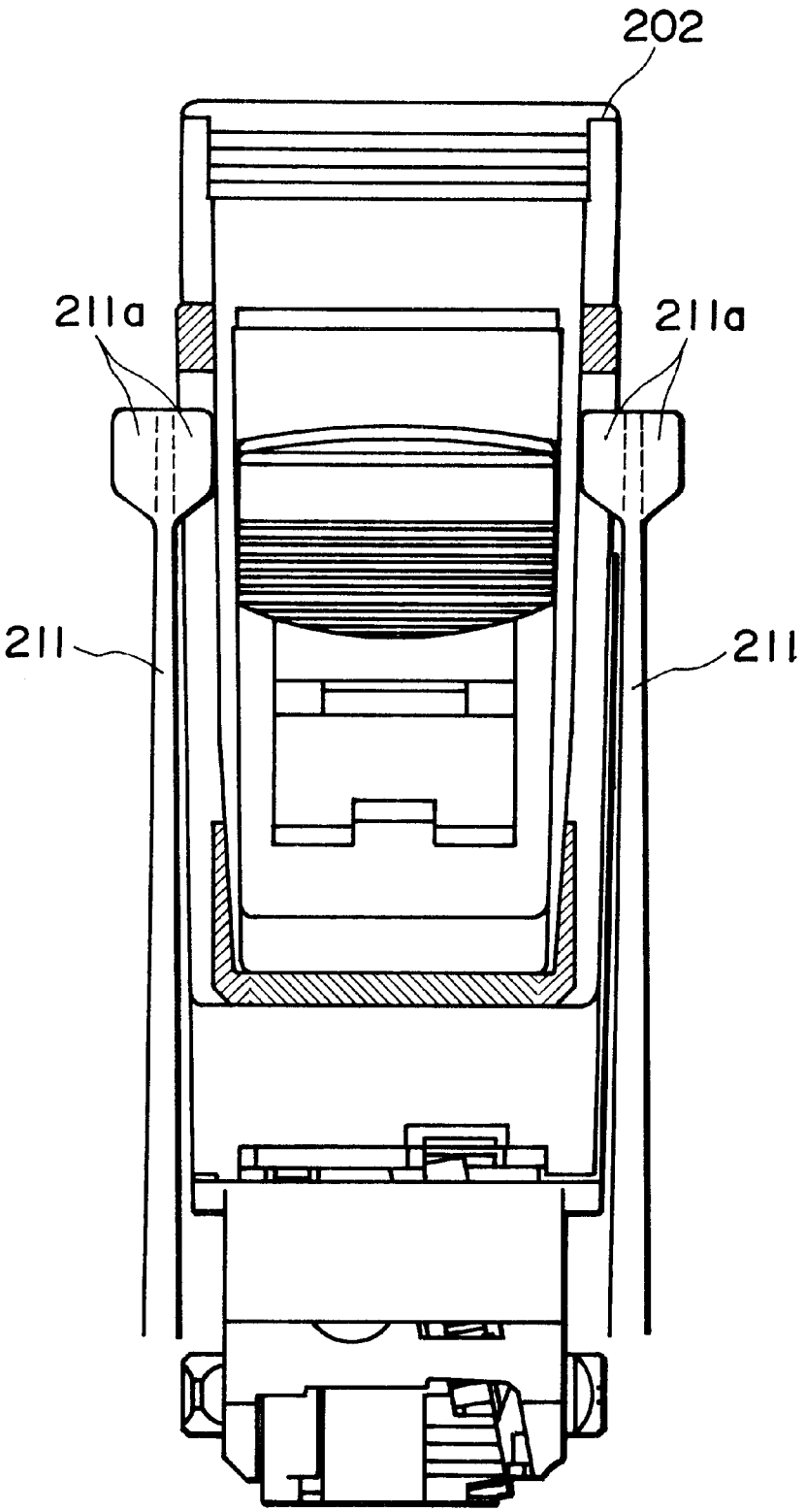
FIG. 25 is an explanatory view showing the insertion relation of the ink jet cartridge into the carriage according to one embodiment of the present invention.

Here, since the protruding amount of the carriage protrusion 211*a* is set to be smaller than the width of a carriage guide narrow part 24*b* of the ink jet cartridge (see FIG. 25), the insertion of the ink jet cartridge into the carriage 201 is impossible in a position other than a position in which the carriage protrusion 211*a* meets the carriage guide narrow part 24*b* of the ink jet cartridge. When the position of the carriage protrusion 211*a* agrees with that of the carriage guide narrow part 24*b* of the ink jet cartridge, the insertion of the ink jet cartridge into the carriage becomes possible. Subsequently, in the initial stage of the ink jet cartridge insertion, the cartridge is inserted downward in the drawing along the carriage guide narrow part 24*b* in the position where the carriage guide narrow part 24*b* of the ink jet cartridge meets the protrusion 211*a* of the carriage 201. In this case, the movement of the ink jet cartridge 202 in the rotation direction is regulated (see FIG. 20).

Figure 21:
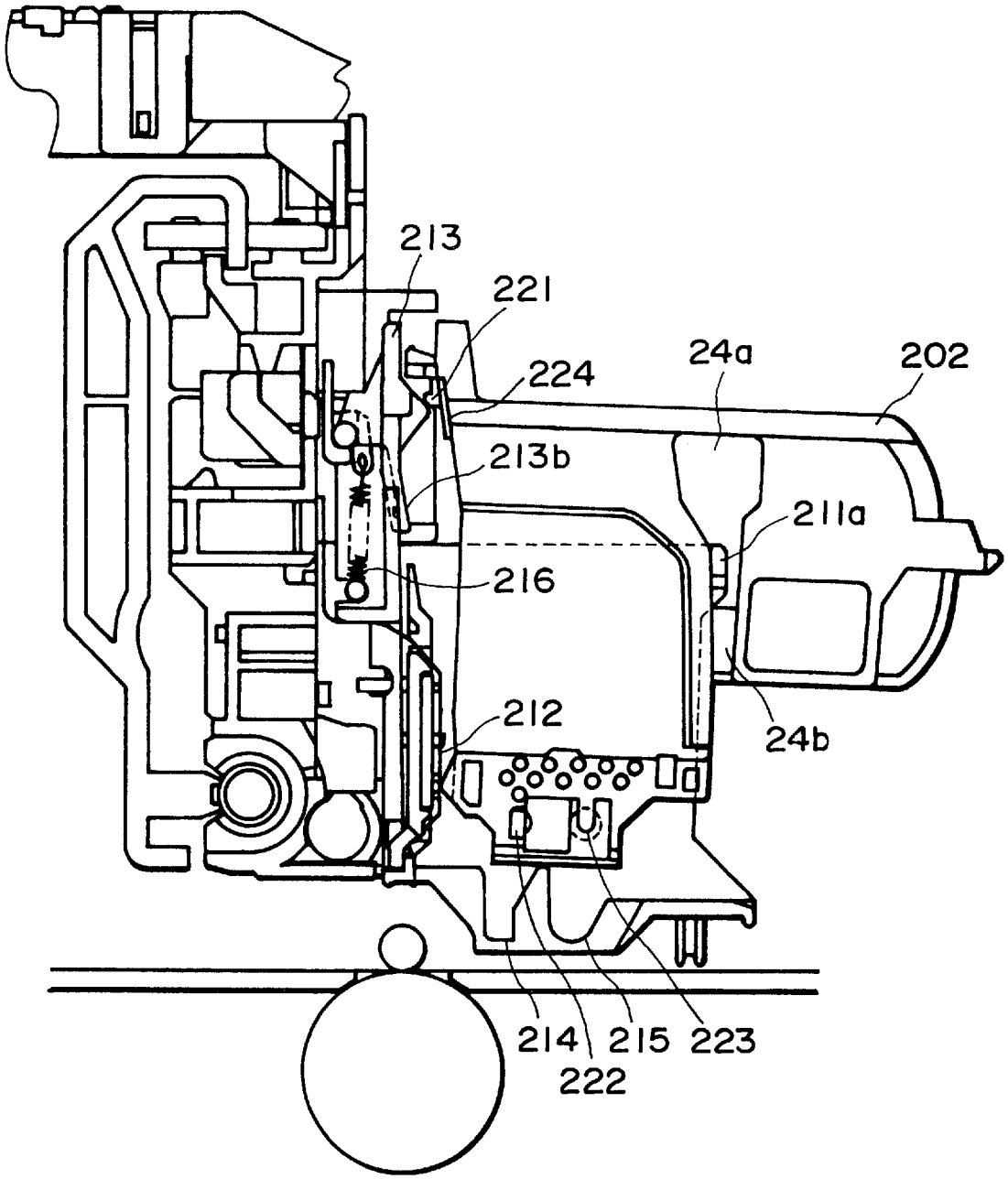
FIG. 21 is an explanatory view showing the operation of inserting the ink jet cartridge into the carriage according to one embodiment of the present invention.

When the ink jet cartridge 202 is further inserted, the lower part of an X' positioning part 221 of the ink jet cartridge is guided by the inclined part of a head hook 213, and the ink jet cartridge 202 is inclined in a direction apart from a contact part 212 (see FIG. 21).

Figure 22:
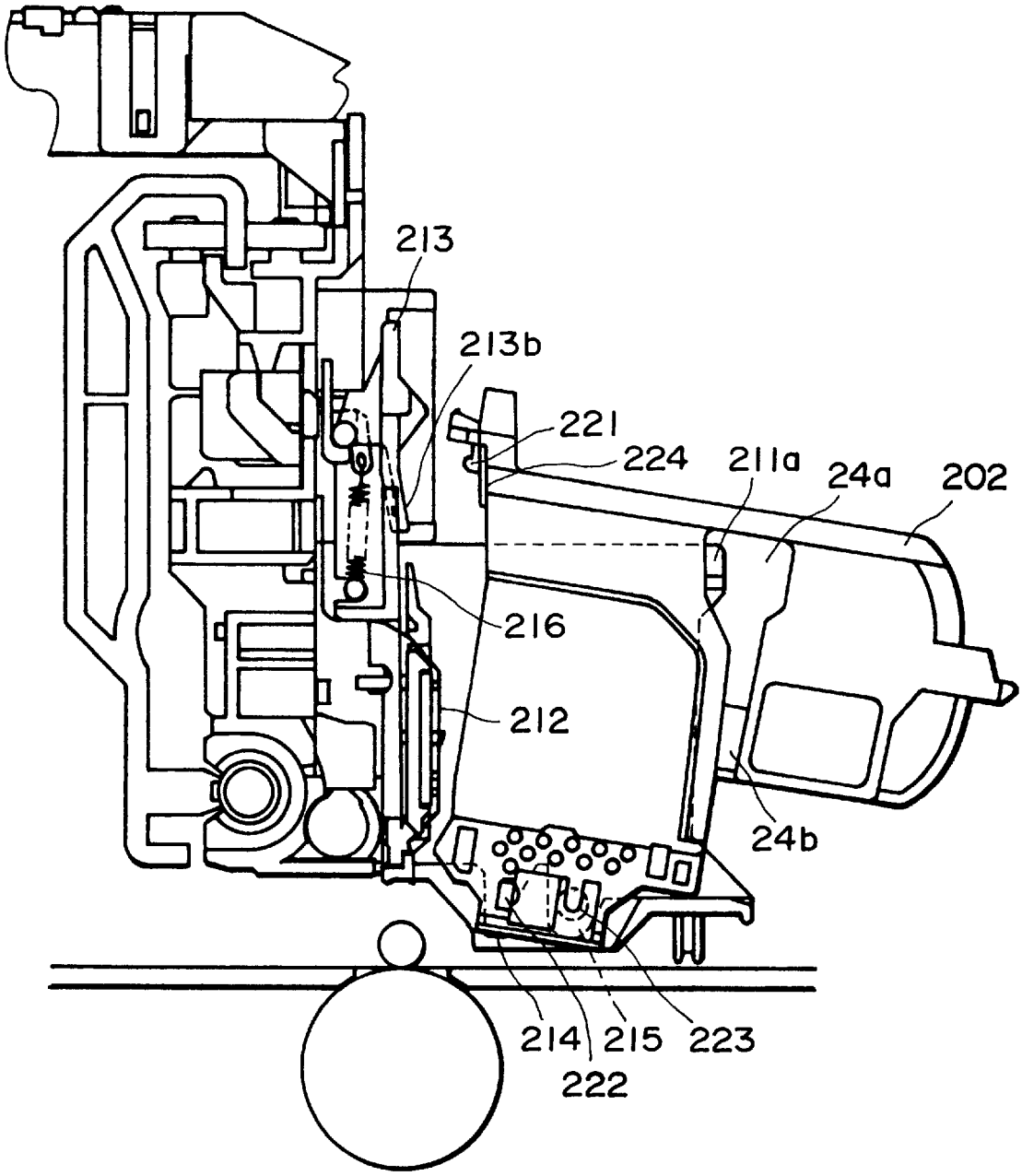
FIG. 22 is an explanatory view showing the operation of inserting the ink jet cartridge into the carriage according to one embodiment of the present invention.
Figure 23:
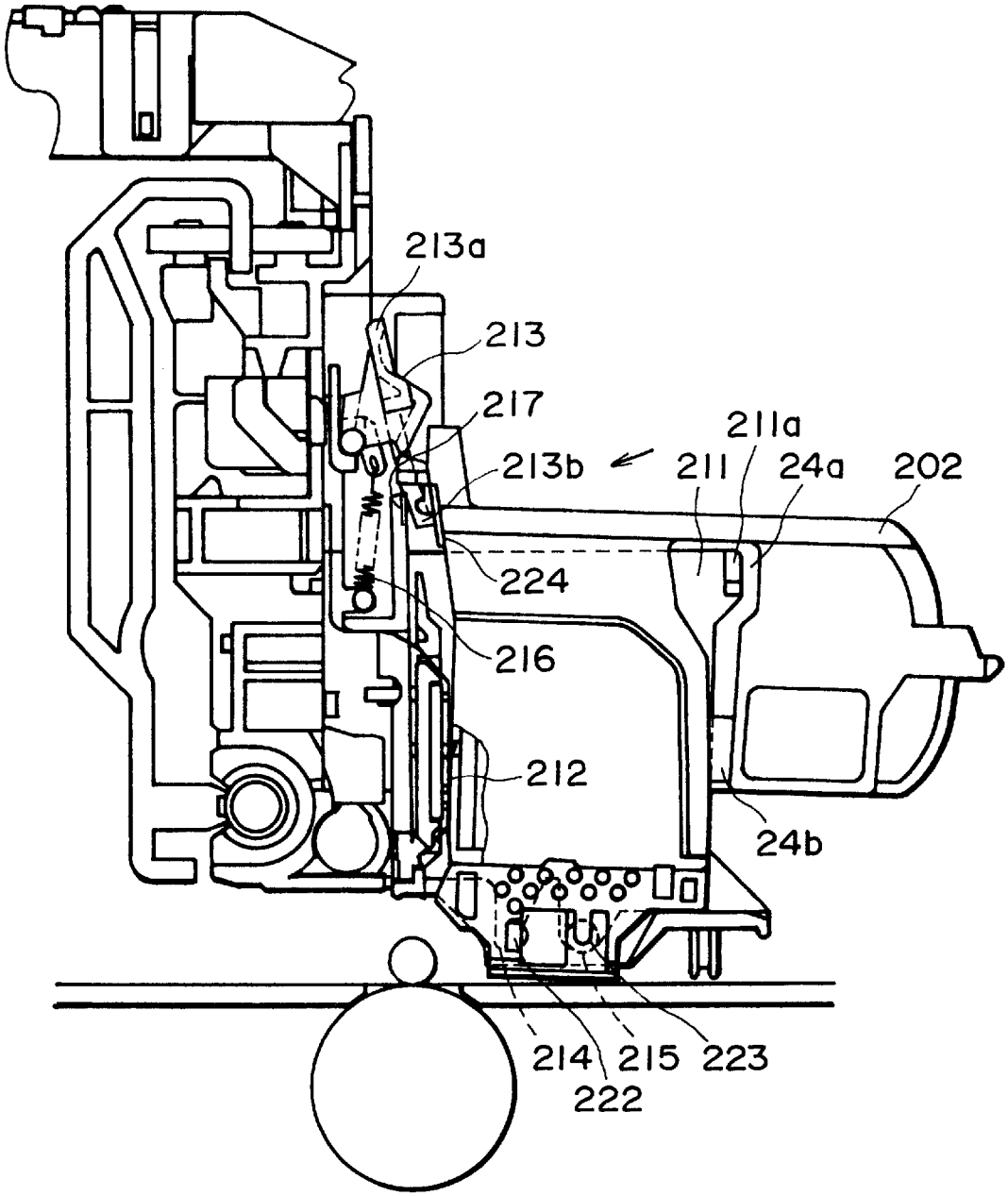
FIG. 23 is an explanatory view showing the operation of inserting the ink jet cartridge into the carriage according to one embodiment of the present invention.

When the ink jet cartridge 202 is continuously inserted, the carriage protrusion 211*a* is drawn into the carriage guide wide part 24*a* opened wide upward from the carriage guide narrow part 24*b* of the ink jet cartridge, the ink jet cartridge 202 is further inclined, an XZ positioning part 222 of the ink jet cartridge is guided by a carriage XZ positioning part 214, the leaf spring for urging the ink jet cartridge 202 allows a Y positioning part 223 of the ink jet cartridge to abut on a Y positioning part 215, and the cartridge is inserted into the bottom of the carriage 201 (see FIG. 22).

Figure 24:
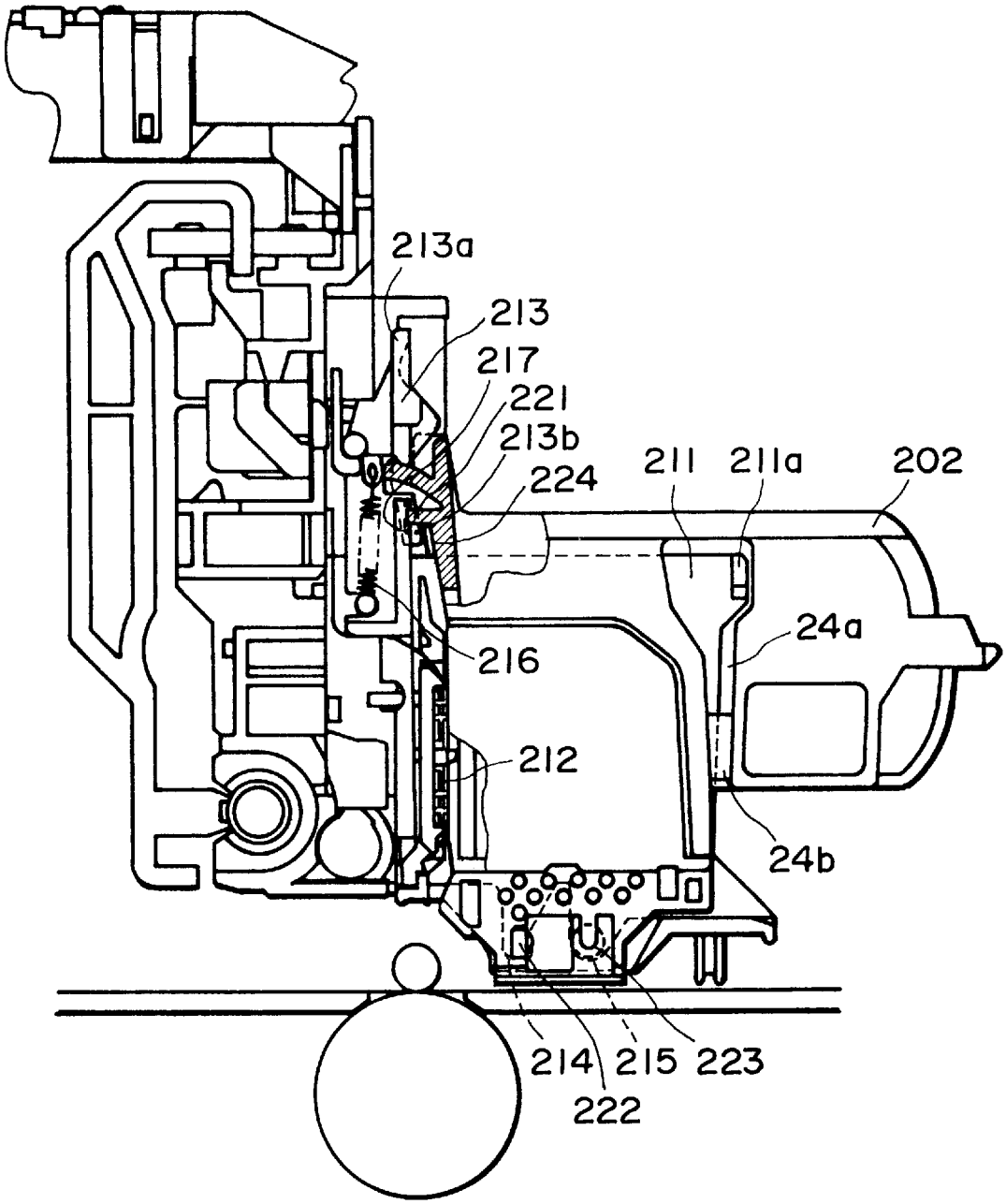
FIG. 24 is an explanatory view showing the operation of inserting the ink jet cartridge into the carriage according to one embodiment of the present invention.

Thereafter, by pressing the pressing part of the ink jet cartridge 202, and rotating the ink jet cartridge 202 in the direction of the contact part 212, the tip end of a head hook receiving part 221*a* of the ink jet cartridge rotates the head hook 213, the tip end of the head hook receiving part 221*a* goes beyond the tip end of the head hook 213, then the ink jet cartridge 202 is drawn in by an extension spring 216, the X' positioning part 221 of the ink jet cartridge abuts on a carriage X' positioning part 217, the state of FIG. 24 is obtained, and the fixing of the ink jet cartridge 202 is completed.

In this fixing completed state, the window depth of the carriage guide wide part 24*a* of the ink jet cartridge is set to be a size such that the carriage protrusion 211*a* is not interfered with.

Moreover, when the removing of the ink jet cartridge 202 is necessary for replacing the ink jet cartridge 202 or the like, by pressing a pressing part 213*a* of the carriage head hook 213, an ink jet cartridge kicking part 213*b* of the head hook 213 abuts on a kick receiving part 224 disposed on the contact surface top part of the ink jet cartridge 202, the ink jet cartridge 202 is inclined in the direction apart from the contact part 212 to return the head hook 213 and the state of FIG. 22 is obtained.

When the ink jet cartridge 202 is further pulled upward, the protrusion 211*a* of the carriage is guided into the carriage guide narrow part 24*b* by the lower taper part of the carriage guide wide part 24*a* of the ink jet cartridge, the rotation is regulated by the carriage protrusion 211*a* and the carriage is extracted upward. Moreover, the carriage guide narrow part 24*b* of the ink jet cartridge has a boundary between the window part and the recess part, but the carriage protrusion 211*a* is tapered toward the partition plate 211 from its top, and the ink jet cartridge 202 can therefore be extracted without being caught by the protrusion 211*a*.

Figure 13:
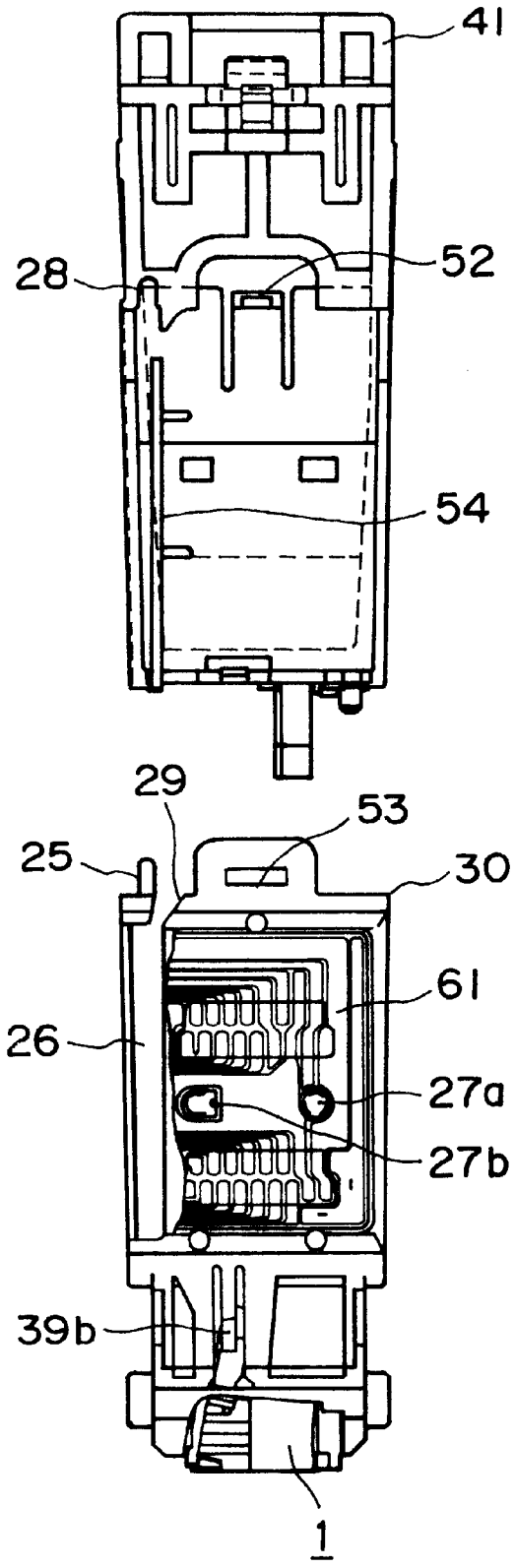
FIG. 13 is an explanatory view showing a cutout part in the head holding member according to one embodiment of the present invention.
Figure 14:
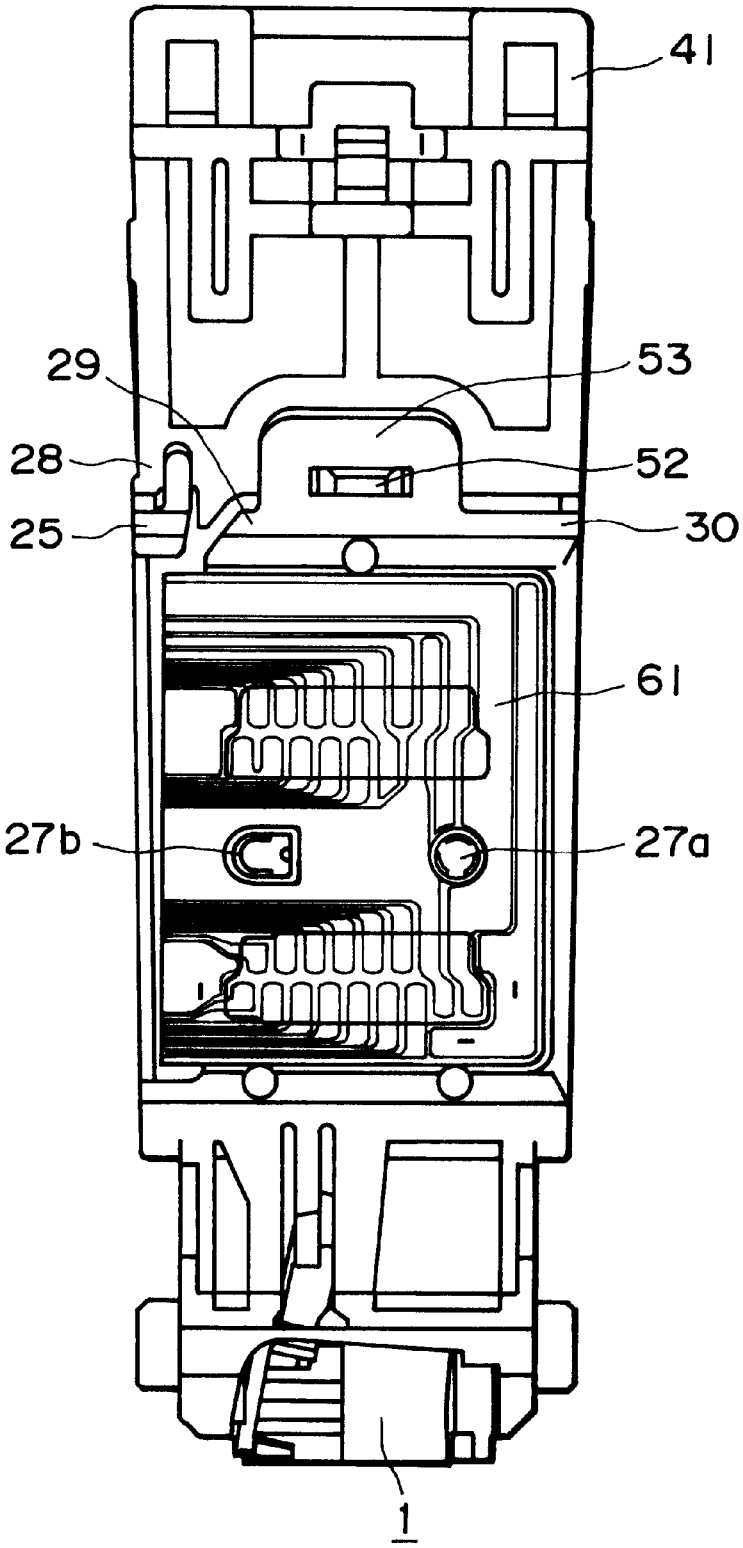
FIG. 14 is a front view showing the head holding member connected to the ink tank holding member according to one embodiment of the present invention.

An operation of bonding the head holding member 30 to the ink tank holding member 41 on the contact part side will next be described with reference to FIGS. 13, 14.

The head holding member 30 is provided with a cutout part 26 for use in drawing the flexible cable 61 to the outside from the inside of the head holding member 30. This cutout part 26 is cut in the ink tank holding member insertion direction of the head holding member 30.

Moreover, a guide rib 54 extended in the ink tank holding member insertion direction is disposed opposite to the cutout part 26 of the ink tank holding member 41. This guide rib 54 is guided by a taper part 29, and guides the side surface of the abutment part 26 during the inserting operation.

Furthermore, during the inserting of the head holding member 30 into the ink tank holding member 41, since a protrusion 25 disposed on the tip end of the head holding member on the end of the cutout part 26 abuts on this guide rib 54 to widen the cutout part 26, the contact of the flexible cable 61 with the ink tank holding member 41 is reduced during the inserting operation. Thereafter, when the ink tank holding member 41 is finally inserted, a click part 52 of the ink tank holding member 41 is clicked in a click receiving part 53 disposed on the tip end of the insertion direction of the head holding member 30, the protrusion 25 engages in a protrusion engagement part 28, and the cutout part 26 is placed in a slit state.

The flexible cable 61 is bonded to the outer surface of the head holding member 30 (the surface forming a contact part) by a hot-melt seat. A groove is made in the periphery of the hot-melt seat placing surface of the head holding member 30, and this groove prevents the molten resin of the hot-melt seat from overflowing during the bonding. Numerals 27*a*, 27*b* of FIGS. 11, 13 denote through ports for passing the flexible cable 61 and head holding member 30. When a jig is protruded from the through ports 27*a*, 27*b*, the flexible cable 61 is positioned with respect to the head holding member 30 and the flexible cable 61 can be bonded to a desired position. Moreover, when the through ports 27*a*, 27*b* receive a pin disposed on the contact part on the carriage side during the mounting of the ink jet cartridge on the ink jet apparatus carriage, the positioning of the electric connection can be secured. In this case, the through port 27*b* is formed in an elongated hole shape in consideration of the tolerance of the pin and through ports 27*a*, 27*b*.

Figure 15:
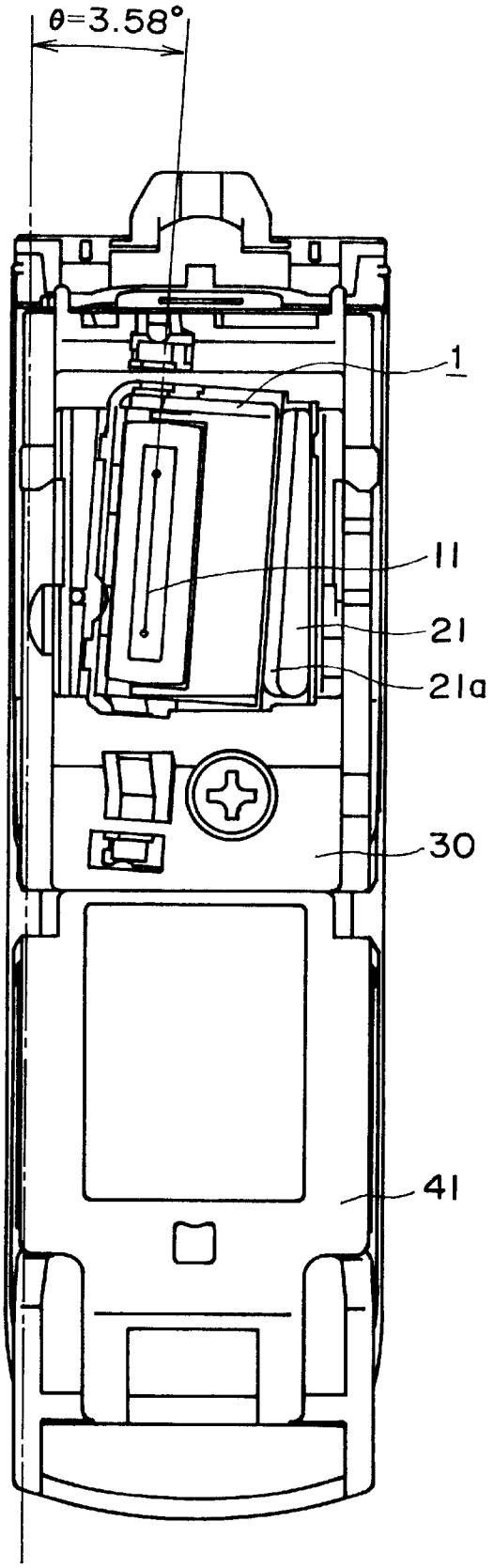
FIG. 15 is a bottom plan view of the ink jet cartridge according to one embodiment of the present invention.

In the ink jet cartridge of the present embodiment constituted as described above, the orifice plate 10 is parallel to the surface of the record sheet 63, and the row of the discharge ports 11 is inclined by about 3.58 degrees with respect to the feeding direction of the record sheet 63 as shown in FIG. 15.

When the row of the discharge ports 11 is parallel to the sheet feeding direction, in order to discharge the ink from all of a multiplicity of discharge ports 11 vertically arranged in FIG. 15, all the discharge ports 11 need to be simultaneously driven.

This is unfavorable because the unstable ink flow state in the common liquid chamber 9 and ink flow path 8, the insufficient ink supply, the increase of power consumption, and other problems are caused.

To solve the problem, by inclining the row of discharge ports 11 with respect to the sheet feeding direction as in the present embodiment, the drive timing of the energy generating element can be shifted, and the above-described problems can be avoided even when the ink is discharged from all the discharge ports 11.

A wiper cleaner will next be described in detail with reference to FIGS. 16A to 16E and FIGS. 17A to 17C.

In the ink jet apparatus for discharging the ink from the discharge port to form an image, when the ink is continuously discharged, the periphery of the discharge port is gradually contaminated with the ink, dust, paper powder, and the like. When this contamination becomes extreme, normal ink discharge cannot be performed, and ink non-discharge occurs in the worst case. Therefore, the ink jet apparatus is provided with a recovery part including a wiper blade for periodically wiping the ink from the periphery of the discharge port. However, when the number of print sheets increases, even the wiper blade is smeared with the ink and the effect is reduced. Therefore, in order to prevent the wiper blade from being smeared with the ink, dust, paper powder, and the like, the wiper cleaner 21 is disposed on the ink jet cartridge to absorb the ink of a wiper blade 203*b* (see FIG. 18), and the wiper blade 203*b* is constantly kept in a clean state. Moreover, since the wiper cleaner 21 is formed of a hydrophilic porous plastic material, the ink is diffused in the entire wiper cleaner 21 by a capillary force. As a result, there is no excess ink on the contact surface with the wiper blade 203*b*, and the ink adhering to the wiper blade can always be absorbed by the wiper cleaner. Moreover, when the ink jet cartridge is of a replaceable type, this wiper cleaner is also periodically in a new product state during the replacement. As a result, the wiper blade can always be used in its optimum state. Moreover, in the ink jet apparatus in which the ink jet cartridge of the present invention is used, as shown in FIGS. 16B to 16E, the wiper blade 203*b* is advanced parallel to the discharge port row and vertically to the surface, and the advancement direction starts from the base plate side. Specifically, the wiping operation is performed while the wiper cleaner 21 is on the downstream side of the wiping direction (arrow direction). In this case, the wiper blade having wiped off the ink on the surface once returns to its original state at a step 21*a* of the wiper cleaner 21, and ink 70 is scraped with the edge of the wiper cleaner 21. The scraped ink 70 is held by the recess part of the step 21*a* and absorbed by the wiper cleaner. Since the surface area of the wiper cleaner 21 in contact with the ink is enlarged particularly by the step shape, the ink can quickly be absorbed.

Figure 16A:
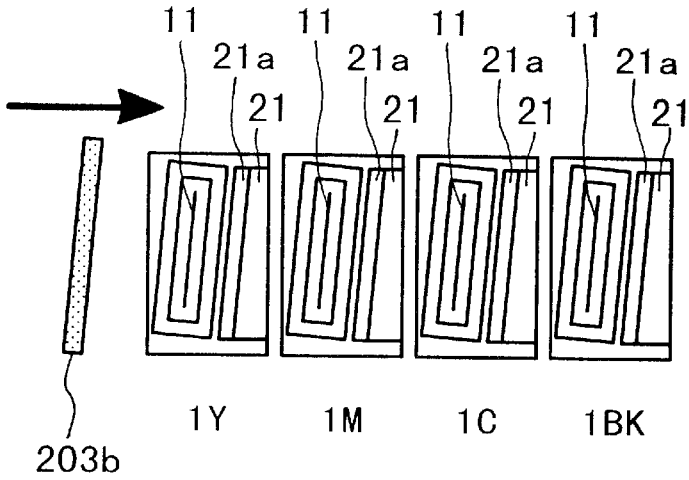
FIGS. 16A, 16B, 16C, 16D and 16E are explanatory views showing a cleaning member in an ink jet apparatus according to one embodiment of the present invention.
Figure 16B:
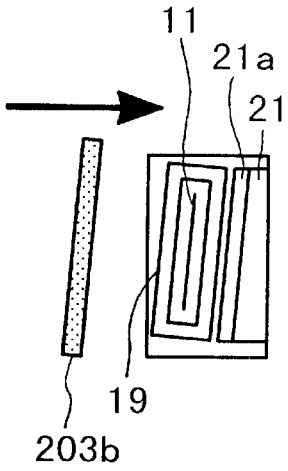
Figure 16C:
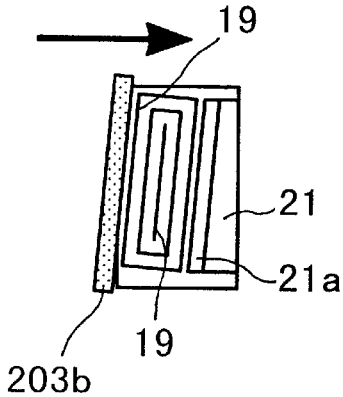
Figure 16D:
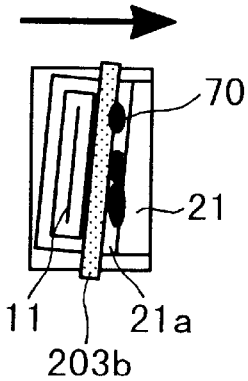
Figure 16E:
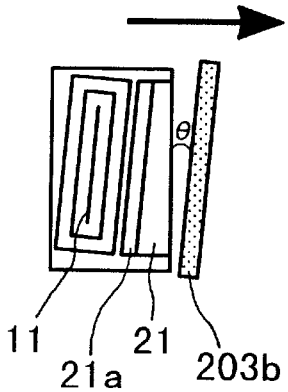

This allows the wiper blade 203*b* to perform more effective cleaning. Moreover, to perform color printing, for example, as shown in FIG. 16A, the ink jet cartridges are mounted on the carriage in order from yellow (Y), magenta (M), cyan (C), and black (Bk). When the wiping of these four ink jet cartridges is continuously performed, and the wiper cleaner is disposed on the downstream side of the wiping direction, the wiper blade is cleaned before the wiping of the adjacent ink jet cartridge, and the ink colors can be prevented from being mixed during wiping.

Furthermore, the wiper cleaner 21 of the present invention wipes the cartridge not only from the base plate side but also from the upstream direction of the wiping direction of the wiper cleaner 21.

Figure 17A:
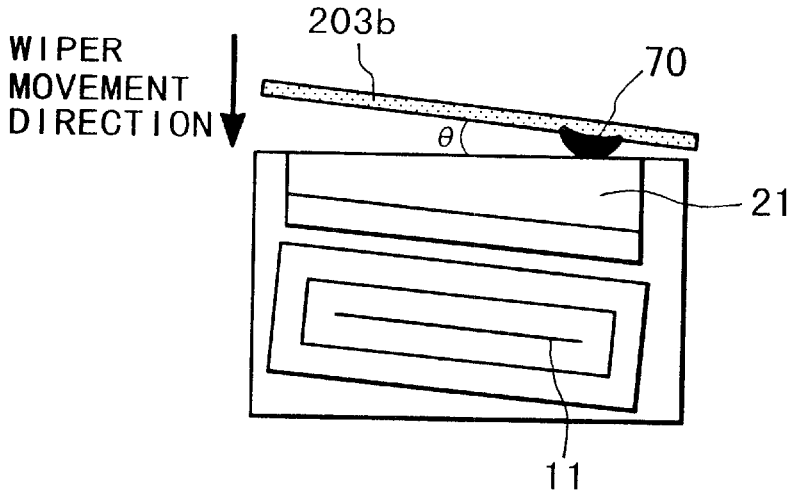
FIGS. 17, 17B and 17C are explanatory views showing a wiper cleaner in the ink jet cartridge according to one embodiment of the present invention.
Figure 17B:
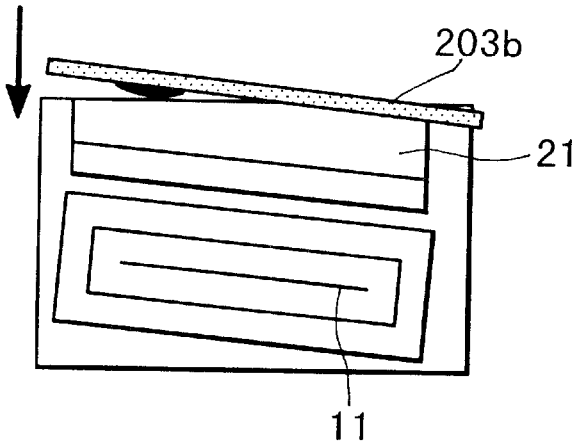
Figure 17C:
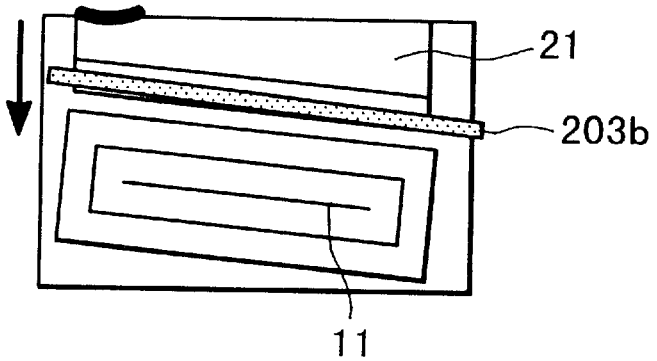

As shown in FIGS. 17A to 17C, when the wiper cleaner 21 performs the wiping from the upstream direction of the wiping direction, the wiper blade 203*b* and wiper cleaner 21 enter with an angle, and the ink 70 adhering to the wiper blade 203*b* gradually moves to the left side from the right side of the drawing. Moreover, since the ink 70 is simultaneously absorbed by the wiper cleaner 21 during the movement, more effective ink absorption can be performed. Furthermore, since the wiper cleaner 21 is formed in a stepped shape, the cleaner has an ink scraping effect similar to that of the edge of the ink supply unit 6. The wiper blade of the present invention constantly performs the optimum cleaning regardless of the wiping direction in this manner. Furthermore, for the stepped shape of the wiper cleaner, the number of edges is increased, additionally the components can be shared with the discharge port protective cap of the ink jet cartridge provided beforehand with no wiper cleaner product, and the cost can be reduced.

Figure 18:
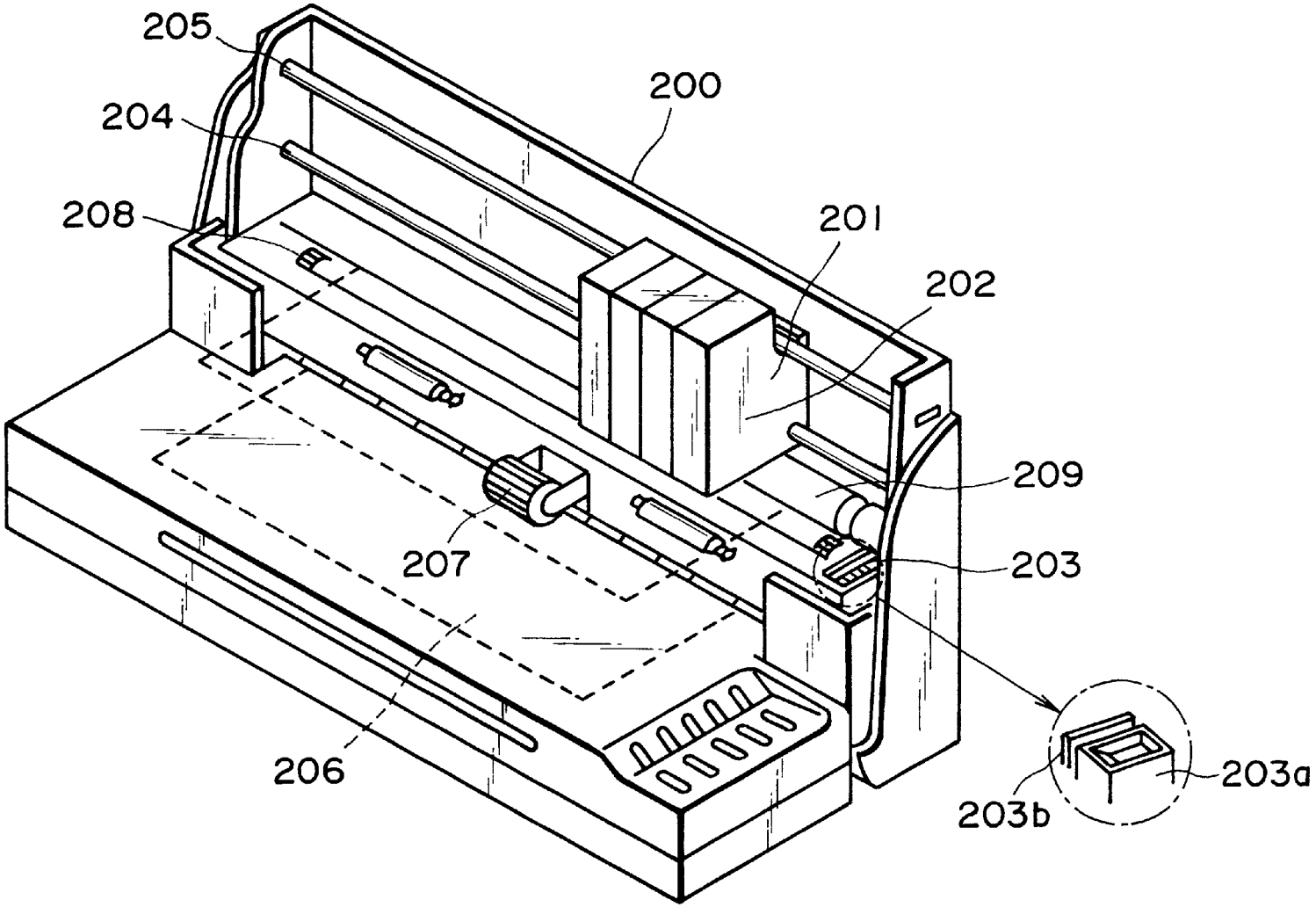
FIG. 18 is a schematic view showing the ink jet apparatus on which the ink jet cartridge of the embodiment of the present invention is mounted.

FIG. 18 is a schematic view showing the constitution of one embodiment of an ink jet apparatus 200 on which the ink jet cartridge of the present embodiment is mounted.

In the ink jet apparatus of FIG. 18, a plurality of ink jet cartridges 202*a* to 202*d* are mounted on the carriage 201 held by a guide axis 205 and lead screw 204, and image recording is performed on a record sheet 206 by moving the carriage 201 in a left-to-right direction.

The guide axis 205 is a fixed axis which plays a role of guiding the carriage 201 in the left-to-right direction during the movement.

Moreover, the lead screw 204 is a rotation axis with a spiral groove (not shown) formed thereon, and the carriage 201 can be moved in the left-to-right direction by rotating the lead screw forward and backward.

The record sheets 206 are stored in the lower part of the ink jet apparatus 200, and fed to the printing part of the ink jet apparatus 200 from below a press plate 209 by a feed roller 207.

When the ink jet cartridge 202 records the image on the record sheet 206, a discharge roller 208 feeds only the necessary printed area of the record sheet 206 and discharges the sheet from the ink jet apparatus 200.

Before or while the ink jet cartridge 202 performs the image recording on the record sheet 206, the recovering operation of the ink jet cartridge 202 is performed in a recovery unit 203 not to deteriorate the image recording quality. This recovery unit 203 is provided with the cap 203*a* which abuts on the surface of the head provided with the discharge ports and which can perform suction recovery, and the wiper blade 203*b* for wiping and cleaning the surface of the head provided with the discharge ports.

According to the present invention, the ink jet cartridge in which the high precision positioning of the ink jet head can easily be performed with respect to the ink jet cartridge and the high quality recording is possible, and the ink jet apparatus using this cartridge can be realized with the simple constitution and at the low cost.

What is claimed is:

1. An ink jet cartridge comprising:

an ink jet head including a plurality of arranged discharge ports for discharging ink, an element substrate provided with a plurality of energy generating elements for generating an energy to discharge the ink, and a base plate for supporting the element substrate;

an ink tank holding member for holding an ink tank for containing the ink; and a head holding member for holding said ink jet head, wherein said ink jet head is positioned and fixed in said head holding member by abutting said ink tank holding member against said ink jet head through an elastic member.

2. The ink jet cartridge according to claim 1 wherein said base plate is inclined with respect to a direction of abutment.

3. The ink jet cartridge according to claim 1 wherein said ink tank holding member comprises an ink supply tube for introducing the ink to said ink jet head, said ink jet head comprises an ink flow inlet port for introducing the ink into said ink jet head from said ink tank, the elastic member is disposed between the ink flow inlet port and said ink supply tube, and the ink jet head is abutted under pressure by resilience of the elastic member to be positioned and fixed in the head holding member.

4. The ink jet cartridge according to claim 2 wherein said ink jet head is positioned and fixed to said ink jet cartridge using a force by a rotation moment.

5. The ink jet cartridge according to claim 4 wherein said ink jet head is fixed to said ink jet cartridge by the force by the rotation moment in which a supporting portion of said head holding member is used as a support point or an axis.

6. The ink jet cartridge according to claim 5, further comprising a head receiving portion which restricts a rotation range of rotation about said supporting portion.

7. The ink jet cartridge according to claim 6 wherein said head receiving portion is disposed in at least three places inside said head holding member.

8. The ink jet cartridge according to claim 7 wherein one of three head receiving portions is positioned near said discharge ports upon insertion of said ink het head into said head holding member, and wherein two others of said three head receiving portions are positioned at substantially equal distances from said one head receiving portion.

9. The ink jet cartridge according to claim 6 wherein a cross-section of the support portion is substantially arc-shaped.

10. The ink jet cartridge according to claim 1 wherein said ink tank holding member comprises a base plate abutment part, and the base plate abutment part has a leaf spring structure.

11. The ink jet cartridge according to claim 1 wherein said head holding member comprises at least two head side face receiving portions for receiving opposite sides of said base plate, said at least two head side receiving portions being arranged in a direction of arranging said plurality of discharge ports.

12. The ink jet cartridge according to claim 11 wherein one of said head side receiving portions has an elastic structure.

13. The ink jet cartridge according to claim 11 wherein a cross-section of each of said head side receiving portions has an R-shaped section.

14. The ink jet cartridge according to claim 3 wherein said ink supply tube of said ink tank holding member has bond pressing pillars with a length substantially the same as that of said ink supply tube at opposite sides thereof, and said ink supply tube is positioned substantially at a center between the bond pressing pillars.

15. The ink jet cartridge according to claim 14 wherein said elastic member has a part corresponding to said bond pressing pillar thicker than a part corresponding to said ink supply tube.

16. The ink jet cartridge according to claim 14 wherein the fixing of said head holding member to said ink tank holding member on the abutment side of said ink jet head is performed by three support parts and a connection part disposed in an area surrounded by said three support parts.

17. The ink jet cartridge according to claim 16 wherein said ink supply tube and the bond pressing pillars are disposed outside the area surrounded with said three support parts.

18. The ink jet cartridge according to claim 1 wherein said head holding member is provided with a contact part to which a flexible cable is attached, the flexible cable being bonded to said ink jet head for transmitting an electric signal to discharge a liquid from said ink jet head, and is further provided with a cutout, cut in a direction of inserting said ink tank holding member, for passing said flexible cable, wherein a part of said flexible cable provided at said contact part is exposed to an outside of said ink tank holding member from said cutout.

19. The ink jet cartridge according to claim 18 wherein said ink tank holding member is provided with a guide which is extended in an insertion direction of said ink tank in a position corresponding to said cutout.

20. The ink jet cartridge according to claim 18 wherein said cutout is disposed on one side of said head holding member.

21. The ink jet cartridge according to claim 19 wherein a protrusion for enlarging the width of said cutout is disposed on a tip end of said head holding member on an end of the cutout.

22. The ink jet cartridge according to claim 21 wherein said ink tank holding member comprises a recess for engaging with said protrusion, and said cutout becomes a slit with engagement between said recess and said protrusion.

23. The ink jet cartridge according to claim 18 wherein said flexible cable is fixed to said head holding member by-a hot-melt seat.

24. The ink jet cartridge according to claim 23 wherein said head holding member is provided with a groove in a periphery of fixation by said hot-melt seat.

25. The ink jet cartridge according to claim 18 wherein said flexible cable includes at least one bent part adapted for the inner shape of said head holding member.

26. The ink jet cartridge according to one of claims 18 to 25 wherein said flexible cable and head holding member are provided with a plurality of through ports which engage with positioning protrusions disposed on an electric contact part on a device side of said ink jet cartridge.

27. The ink jet cartridge according to claim 26 wherein at least one of said plurality of through ports has an elongated hole shape.

28. The ink jet cartridge according to claim 1 wherein a wiper cleaner for cleaning a wiper blade disposed on an ink jet apparatus to which the cartridge is mountable, for wiping the surface of said ink jet head provided with the discharge port, is disposed at a gap between said head holding member and the ink jet head.

29. The ink jet cartridge according to claim 28 wherein a step is disposed on the ink jet head side of said wiper cleaner.

30. An ink jet apparatus comprising an ink jet cartridge according to any one of claims 1 to 25, 28 or 29; and record material conveyance means for conveying a record material for receiving a liquid discharged from said ink jet head of the ink jet cartridge, wherein said ink jet cartridge is mounted in an attachable/detachable state.

31. An ink jet apparatus comprising an ink jet cartridge according to claim 26; and record material conveyance means for conveying a record material for receiving a liquid discharged from said ink jet head of the ink jet cartridge, wherein said ink jet cartridge is mounted in an attachable/detachable state.

32. An ink jet apparatus comprising an ink jet cartridge according to any one of claims 1 to 25, 28 or 29; and recovery means for performing a recovery treatment of said ink jet head of the ink jet cartridge, wherein said ink jet cartridge is mounted in an attachable/detachable state.

33. An ink jet apparatus comprising an ink jet cartridge according to claim 26; and recovery means for performing a recovery treatment of said ink jet head of the ink jet cartridge, wherein said ink jet cartridge is mounted in an attachable/detachable state.

34. The ink jet apparatus according to claim 32 wherein said recovery means comprises suction recovery means.

35. The ink jet apparatus according to claim 33 wherein said recovery means comprises suction recovery means.

36. The ink jet apparatus according to claim 32 wherein said recovery means comprises a wiper blade for wiping the surface of said ink jet head provided with a discharge port.

37. The ink jet apparatus according to claim 33 wherein said recovery means comprises a wiper blade for wiping the surface of said ink jet head provided with a discharge port.

38. The ink jet apparatus according to claim 36 wherein said ink jet cartridge comprises a wiper cleaner for cleaning said wiper blade between said head holding member and the ink jet head.

39. The ink jet apparatus according to claim 37 wherein said ink jet cartridge comprises a wiper cleaner for cleaning said wiper blade between said head holding member and the ink jet head.

40. The ink jet apparatus according to claim 38 wherein a step is disposed on an ink jet head side of said wiper cleaner.

41. The ink jet apparatus according to claim 39 wherein a step is disposed on an ink jet head side of said wiper cleaner.

42. The ink jet apparatus according to claim 36 wherein a plurality of ink jet cartridges are arranged, and a single wiper blade is disposed for cleaning respective discharge ports of the plurality of ink jet cartridges.

43. The ink jet apparatus according to claim 37 wherein a plurality of ink jet cartridges are arranged, and a single wiper blade is disposed for cleaning respective discharge ports of the plurality of ink jet cartridges.

44. The ink jet apparatus according to claim 38 wherein the wiper blade is contacted to said wiper cleaner at a predetermined angle.

45. The ink jet apparatus according to claim 39 wherein the wiper blade is contacted to said wiper cleaner at a predetermined angle.

46. An ink jet cartridge comprising:

an ink jet head comprising a plurality of arranged discharge ports for discharging ink, and an element substrate provided with a plurality of energy generating elements for generating an energy to discharge the ink;

an ink tank holding member for holding an ink tank for containing the ink; and a head holding member for holding said ink jet head, wherein said ink jet head is sandwiched by said ink tank holding member and said head holding member.

47. An ink jet cartridge comprising:

an ink jet head comprising a plurality of arranged discharge ports for discharging ink, and an element substrate provided with a plurality of energy generating elements for generating an energy to discharge the ink;

an ink tank holding member for holding an ink tank for containing the ink; and a head holding member for holding said ink jet head, wherein said ink jet head is movably supported between said ink tank holding member and said head holding member.

48. An ink jet cartridge comprising:

an ink jet head comprising a plurality of arranged discharge ports for discharging ink, and an element substrate provided with a plurality of energy generating elements for generating an energy to discharge the ink;

an ink tank holding member for holding an ink tank for containing the ink; and a head holding member for connecting the ink tank holding member to said ink jet head, wherein said ink jet head is sandwiched and mounted between said ink tank holding member and said head holding member, and the fixing of said head holding member to said ink tank holding member is performed by three support parts provided at a joint portion of said ink tank holding member and a connection part disposed in an area surrounded by the three support parts.

49. An ink jet cartridge comprising:

an ink jet head comprising a plurality of arranged discharge ports for discharging ink, an element substrate provided with a plurality of energy generating elements for generating an energy to discharge the ink, and a base plate for supporting the element substrate;

an ink tank holding member for holding an ink tank for containing the ink; and a head holding member for connecting the ink tank holding member to said ink jet head, wherein said ink jet head is sandwiched and mounted between said ink tank holding member and said head holding member, and said ink tank holding member is provided with a support member for elastically supporting said base plate of the ink jet head sandwiched between said ink tank holding member and said head holding member.

50. An ink jet cartridge comprising:

an ink jet head comprising a plurality of discharge ports arranged on a discharge port surface for discharging ink, and an element substrate provided with a plurality of energy generating elements for generating an energy to discharge the ink;

an ink tank holding member for holding an ink tank for containing the ink; and a head holding member for connecting the ink tank holding member to said ink jet head, wherein a wiper cleaner for cleaning a wiper blade is disposed on the place of said head holding member adjacent to said ink jet head in an area corresponding to said wiper blade for wiping off the discharge port surface of said ink jet head.

51. An ink jet cartridge attachably/detachably mounted on a carriage of an ink jet apparatus, comprising:

an ink jet head comprising a plurality of arranged discharge ports for discharging ink, and an element substrate provided with a plurality of energy generating elements for generating an energy to discharge the ink;

an ink tank holding member for holding an ink tank for containing the ink; and a head holding member for connecting the ink tank holding member to said ink jet head, wherein the carriage is provided with a partition plate for partitioning a space for mounting a plurality of ink jet cartridges and the partition plate is provided with a guide groove for guiding such cartridge to a predetermined position by cooperation with a portion of said ink jet apparatus upon mounting on said ink jet apparatus.

52. An ink jet apparatus on which a plurality of ink jet cartridges are attachably/detachably mounted, each ink jet cartridge comprising an ink jet head including a plurality of arranged discharge ports for discharging ink and an element substrate provided with a plurality of energy generating elements for generating an energy to discharge the ink, an ink tank holding member for holding an ink tank for containing the ink, and a head holding member for connecting the ink tank holding member to said ink jet head, wherein the carriage is provided with a partition plate for partitioning said plurality of ink jet cartridges, and the partition plate is provided with a protrusion for engaging with a guide groove on a part of a housing of said ink jet cartridge in order to mount/guide said ink jet cartridge to said carriage.

53. A method of manufacturing an ink jet cartridge which includes an ink jet head including a plurality of arranged discharge ports for discharging ink and an element substrate provided with a plurality of energy generating elements for generating an energy to discharge the ink, an ink tank holding member for holding an ink tank for containing the ink, and a head holding member for connecting the ink tank holding member to said ink jet head, said ink jet cartridge manufacturing method comprising the steps of:

assembling said head holding member with said ink jet head; and connecting the assembly of said head holding member and said ink jet head to said ink tank holding member via an elastic member disposed between said ink jet head and said ink tank holding member.

54. The ink jet cartridge manufacturing method according to claim 53, further comprising the step of mounting a wiper cleaner to said head holding member prior to the step of connecting the assembly to said ink tank holding member.

55. An ink jet cartridge comprising:

an ink tank holding member for holding an ink tank for containing ink; and a head holding member for holding an ink jet head, said ink jet cartridge being constituted by connection of said ink tank holding member and said head holding member, wherein said head holding member comprises a contact part constituted by attaching a flexible cable, which is connected to said ink jet head for transmitting an electric signal to discharge a liquid from said ink jet head, to an end portion side of a cutout disposed on one side of said head holding member and cut in an insertion direction of said ink tank holding member and a protrusion for enlarging a width of said cutout, wherein said ink tank holding member comprises a guide extended corresponding to said cutout; and a recess engaging with said protrusion, and wherein said protrusion fixes and positions by insertion into said guide.

56. The ink jet cartridge according to claim 55 wherein by inserting the guide of said ink tank holding member into the cutout of said head holding member, and fitting the protrusion of said head holding member in the recess of said ink tank holding member, said cutout part becomes a slit.

57. An ink jet cartridge according to claim 1 wherein said head holding member is provided with a supporting portion for receiving said ink jet head with a minimum area.

58. An ink jet cartridge according to claim 1, wherein said elastic member is separated from the ink tank.

59. An ink jet cartridge according to claim 1, wherein said head holding member is integrated with the ink tank.

60. An ink jet cartridge according to claim 12, wherein the elastic structure of said head side face receiving portion is a leaf spring structure.

61. An ink jet cartridge according to claim 3, wherein said elastic member comprises an introducing tube portion having a function of sealing said ink supply tube and said ink flow inlet port of said ink jet head, and bond pressing pillar portions for generating resilience between said bond pressing pillar portions and said ink jet head, wherein the introducing tube portion is substantially centered between the bond pressing pillar portions.

62. An ink jet cartridge according to claim 61, wherein said resilience of said bond pressing pillar portions does not interfere with a function for sealing said ink supply tube of said ink tank holding member and said ink flow inlet of said ink jet head.

* * * * *

UNITED STATES PATENT AND TRADEMARK OFFICE

CERTIFICATE OF CORRECTION

PATENT NO. : 6,402,310 B1
DATED : June 11, 2002
INVENTOR(S) : Hiroyuki Maeda et al.

It is certified that error appears in the above-identified patent and that said Letters Patent is hereby corrected as shown below:

Column 3,
Line 65, "FIGS. 17," should read -- FIGS. 17A, --.

Column 11,
Line 5, "Subsequently," should read -- ¶ Subsequently --.

Column 15,
Line 16, "het" should read -- jet --; and
Line 45, "14" should read -- 62 --.

Column 16,
Line 16, "by-a" should read -- by a --.

Signed and Sealed this

Third Day of December, 2002

JAMES E. ROGAN
*Director of the United States Patent and Trademark Office*